US010573121B2

(12) United States Patent
Halvorson et al.

(10) Patent No.: US 10,573,121 B2
(45) Date of Patent: Feb. 25, 2020

(54) GAMING SYSTEM AND METHOD HAVING NON-INTERACTING REELS WHILE EVALUATING DISPLAYED SYMBOL COMBINATIONS FOR WINNING SYMBOL COMBINATIONS

(71) Applicant: ADP GAUSELMANN GMBH, Espelkamp (DE)

(72) Inventors: Michael Charles Halvorson, Las Vegas, NV (US); Josef Alexander Hartl, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/120,515

(22) Filed: Sep. 4, 2018

(65) Prior Publication Data

US 2019/0102978 A1 Apr. 4, 2019

Related U.S. Application Data

(63) Continuation of application No. 15/721,808, filed on Sep. 30, 2017, now Pat. No. 10,089,819.

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3244* (2013.01); *G07F 17/3267* (2013.01); *G07F 17/3288* (2013.01); *G07F 17/34* (2013.01)

(58) Field of Classification Search
CPC ..... G07F 17/3204; G07F 17/3206; G07F 17/3211; G07F 17/3213; G07F 17/3244; G07F 17/326; G07F 17/3267; G07F 17/32
See application file for complete search history.

(56) References Cited

U.S. PATENT DOCUMENTS

| | | | |
|---|---|---|---|
| 5,980,384 | A | 11/1999 | Barrie |
| 6,159,095 | A | 12/2000 | Frohm et al. |
| 6,251,013 | B1 | 6/2001 | Bennett |
| 6,290,600 | B1 | 9/2001 | Glasson |
| 6,311,976 | B1 | 11/2001 | Yoseloff et al. |
| 6,319,124 | B1 | 11/2001 | Baerlocher et al. |
| 6,394,902 | B1 | 5/2002 | Glavich et al. |
| 6,517,432 | B1 | 2/2003 | Jaffe |
| 6,558,254 | B2 | 5/2003 | Baerlocher et al. |
| 6,561,900 | B1 | 5/2003 | Baerlocher et al. |
| 6,632,140 | B2 | 10/2003 | Berman et al. |
| 6,692,356 | B2 | 2/2004 | Baerlocher et al. |

(Continued)

OTHER PUBLICATIONS

EIC 3700 STIC Search Results, Jan. 16, 2018, pp. 1-11.

*Primary Examiner* — Omkar A Deodhar
(74) *Attorney, Agent, or Firm* — Resolute Legal PLLC

(57) ABSTRACT

A gaming system and method may include a first set of gaming reels that is oriented a first way and at least one non-interacting reel that is oriented differently with respect to the first set of gaming reels. The gaming system may evaluate symbol combinations displayed on the first set of gaming reels without evaluating symbols displayed on the non-interacting reels to determine any winning symbol combinations. However, the symbols displayed on the non-interacting reels may interact with symbols on the first set of gaming reels to alter the displayed symbol combinations and thus change the winning symbol combinations.

21 Claims, 15 Drawing Sheets

(56) References Cited

U.S. PATENT DOCUMENTS

| | | | |
|---|---|---|---|
| 6,780,109 | B2 | 8/2004 | Kaminkow |
| 6,866,583 | B2 | 3/2005 | Glavich et al. |
| 6,896,617 | B2 | 5/2005 | Daly |
| 6,921,335 | B2 | 7/2005 | Rodgers et al. |
| 7,052,395 | B2 | 5/2006 | Glavich et al. |
| 7,137,888 | B2 | 11/2006 | Glavich et al. |
| 7,384,334 | B2 | 6/2008 | Glavich et al. |
| 7,393,277 | B2 | 7/2008 | Jackson |
| 7,396,282 | B2 | 7/2008 | Gauselmann |
| 7,399,225 | B2 | 7/2008 | Kaminkow |
| 7,736,223 | B2 | 6/2010 | Pace |
| 7,749,071 | B2 | 7/2010 | Marks et al. |
| 7,922,573 | B2 | 4/2011 | Baerlocher et al. |
| 7,927,204 | B2 | 4/2011 | Debrabander, Jr. et al. |
| 7,959,504 | B2 | 6/2011 | Baumgartner et al. |
| 8,002,626 | B2 | 8/2011 | Englman |
| 8,137,180 | B2 | 3/2012 | Thomas et al. |
| 8,152,627 | B2 | 4/2012 | Berman et al. |
| 8,162,741 | B2 | 4/2012 | Wadleigh et al. |
| 8,197,330 | B2 | 6/2012 | Englman et al. |
| 8,231,460 | B2 | 7/2012 | Gauselmann |
| 8,272,944 | B2 | 9/2012 | Englman et al. |
| 8,357,041 | B1 | 1/2013 | Saunders |
| 8,382,571 | B2 | 2/2013 | Marks et al. |
| 8,469,793 | B2 | 6/2013 | Visser |
| 8,506,380 | B2 | 8/2013 | Hughes et al. |
| 8,517,814 | B2 | 8/2013 | Visser |
| 8,574,061 | B2 | 11/2013 | Marks et al. |
| 8,608,543 | B2 | 12/2013 | Cuddy et al. |
| 8,622,809 | B1 | 1/2014 | Arora et al. |
| 8,814,658 | B2 | 8/2014 | Marks et al. |
| 8,840,457 | B1 | 9/2014 | Basallo et al. |
| 9,011,233 | B2 | 4/2015 | Ryan |
| 9,129,492 | B2 | 9/2015 | Marks et al. |
| 9,153,090 | B2 | 10/2015 | Pacey et al. |
| 9,177,448 | B2 | 11/2015 | Caputo et al. |
| 9,214,067 | B2 | 12/2015 | Basallo et al. |
| 9,218,705 | B2 | 12/2015 | Taylor |
| 9,449,470 | B2 | 9/2016 | Baerlocher et al. |
| 9,460,587 | B2 | 10/2016 | Saunders et al. |
| 9,704,342 | B2 | 7/2017 | Aoki et al. |
| 9,710,998 | B2 | 7/2017 | Nelson et al. |
| 9,786,116 | B2 | 10/2017 | Saunders |
| 9,805,542 | B2 | 10/2017 | Rodgers et al. |
| 9,805,553 | B2 | 10/2017 | Zielinski et al. |
| 9,852,574 | B2 | 12/2017 | Zoltewicz et al. |
| 2001/0054794 | A1 | 12/2001 | Cole et al. |
| 2003/0022712 | A1 | 1/2003 | Locke |
| 2004/0043809 | A1 | 3/2004 | Gomez et al. |
| 2004/0048646 | A1 | 3/2004 | Visocnik |
| 2005/0130737 | A1 | 6/2005 | Englman et al. |
| 2005/0159208 | A1 | 7/2005 | Pacey |
| 2006/0058097 | A1 | 3/2006 | Berman et al. |
| 2006/0068892 | A1 | 3/2006 | Gomez et al. |
| 2006/0154717 | A1 | 7/2006 | Jackson |
| 2006/0189377 | A1 | 8/2006 | Gomez et al. |
| 2009/0131150 | A1 | 5/2009 | Iverson et al. |
| 2009/0137311 | A1 | 5/2009 | Iverson et al. |
| 2011/0034234 | A1 | 2/2011 | Berman et al. |
| 2011/0117989 | A1 | 5/2011 | Kennedy et al. |
| 2011/0230251 | A1 | 9/2011 | Nicely et al. |
| 2013/0143639 | A1 | 6/2013 | Nakamura |
| 2014/0038693 | A1 | 2/2014 | Lanning et al. |
| 2014/0274294 | A1 | 9/2014 | Baerlocher et al. |
| 2014/0357342 | A1 | 12/2014 | Elias |
| 2015/0310699 | A1 | 10/2015 | Meyer |
| 2015/0348374 | A1 | 12/2015 | Dupuis |
| 2016/0078711 | A1 | 3/2016 | Rucker |
| 2016/0086429 | A1 | 3/2016 | Inamura et al. |

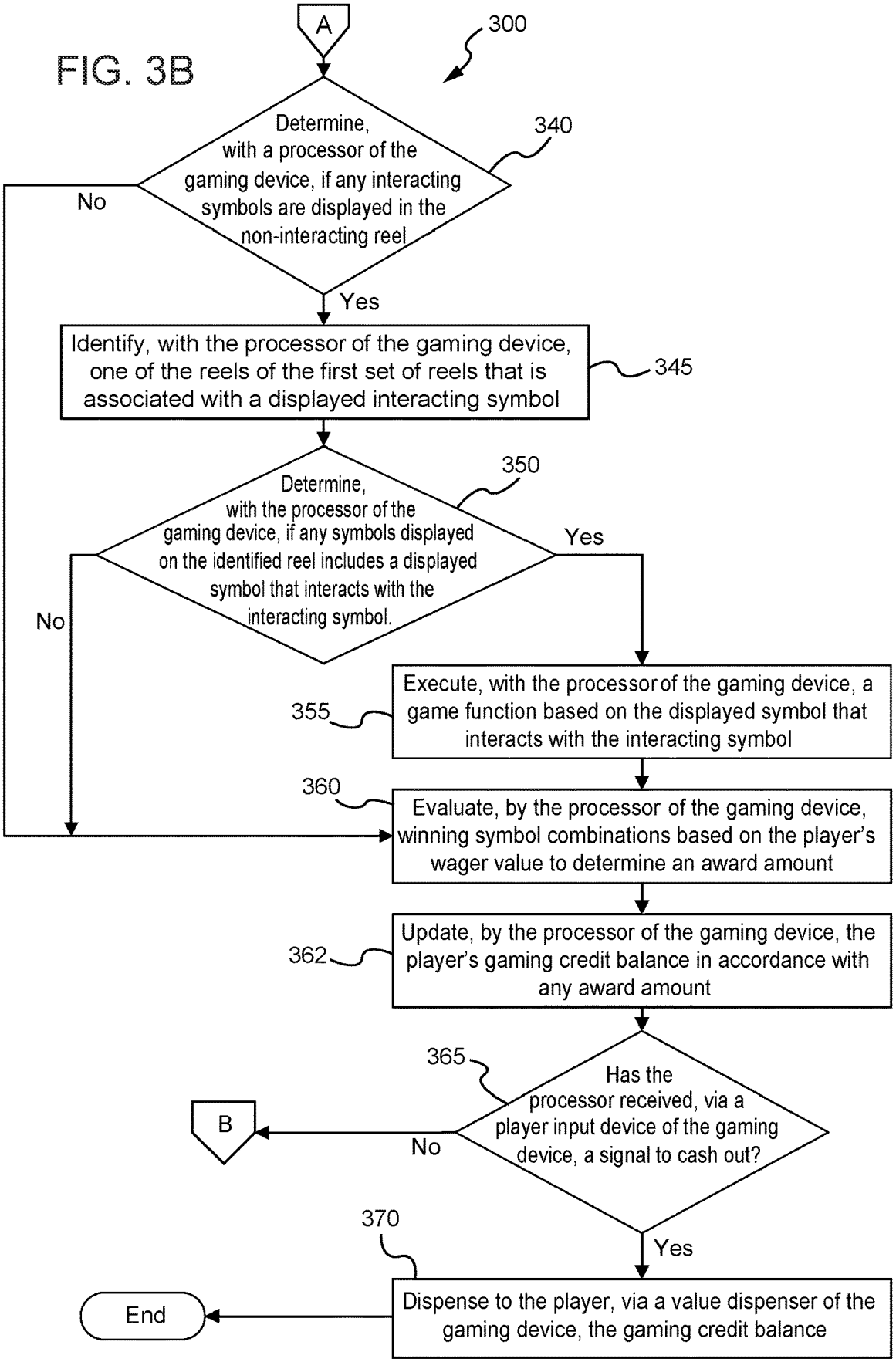
FIG. 3B
A
300
Determine, with a processor of the gaming device, if any interacting symbols are displayed in the non-interacting reel
340
No
Yes
Identify, with the processor of the gaming device, one of the reels of the first set of reels that is associated with a displayed interacting symbol
345
Determine, with the processor of the gaming device, if any symbols displayed on the identified reel includes a displayed symbol that interacts with the interacting symbol.
350
Yes
No
Execute, with the processor of the gaming device, a game function based on the displayed symbol that interacts with the interacting symbol
355
360
Evaluate, by the processor of the gaming device, winning symbol combinations based on the player's wager value to determine an award amount
Update, by the processor of the gaming device, the player's gaming credit balance in accordance with any award amount
362
365
Has the processor received, via a player input device of the gaming device, a signal to cash out?
B
No
Yes
370
Dispense to the player, via a value dispenser of the gaming device, the gaming credit balance
End

GAMING SYSTEM AND METHOD HAVING NON-INTERACTING REELS WHILE EVALUATING DISPLAYED SYMBOL COMBINATIONS FOR WINNING SYMBOL COMBINATIONS

CROSS-REFERENCE TO RELATED APPLICATION

This application is a continuation of U.S. application Ser. No. 15/721,808 filed Sep. 30, 2017, the entire contents of which are incorporated herein by reference.

FIELD OF THE INVENTION

The present disclosure relates to gaming devices.

SUMMARY OF THE INVENTION

In various embodiments, a gaming system and method display a plurality of columns of symbols and at least one separate row (or non-interacting row) of symbols. In one embodiment, gaming system may evaluate the symbols generated for the plurality of columns for winning symbol combinations without evaluating symbols generated for the at least one separate row of symbols to determine if any winning symbol combinations are displayed. In other words, the at least one separate row of symbols is a non-interacting row because the non-interacting row of symbols is not used during the evaluation of the generated symbol combinations to determine winning symbol combinations.

In some embodiments, the plurality of columns of symbols are formed for a first set of gaming reels that is oriented a first way and the at least one separate row of symbols is formed for at least one non-interacting reel that is oriented differently with respect to the first set of gaming reels. In one such embodiment, the gaming system evaluates symbols displayed on the first set of gaming reels without evaluating symbols displayed on the non-interacting reel to determine if the symbols displayed on the first set of gaming reels form any winning symbol combinations. However, in one embodiment, the certain symbols displayed on the non-interacting reel may interact with symbols on the first set of gaming reels to alter the displayed symbols to change the symbol combinations and to possibly create winning symbol combinations. In one such embodiment, if the gaming system generates and displays a certain symbol, such as an interacting symbol, on the non-interacting reel and also generates and displays a particular symbol on the first set of gaming reels that interacts with the interacting symbol, the gaming system executes a predetermined interaction between the particular symbol and the interacting symbol. The gaming system can evaluate (or reevaluate in some embodiments) symbols displayed on the first set of gaming reels to determine the existence of any winning symbol combinations. The winning symbol combinations can be evaluated based on pay lines, way pays, scatter pays, or other suitable types of evaluations.

The gaming system may execute different interactions between certain symbols from the first set of gaming reels and the interacting symbols from the non-interacting reel. In one embodiment, the interaction may include the gaming system altering one or more symbols on a particular reel to a different symbol. In one embodiment, the interaction may include the gaming system causing one displayed symbol on a particular reel of the first set of reels to change all the other displayed symbols on the same particular reel to the one displayed symbol. In another embodiment, the interaction may include triggering a bonus game or a predetermined number of free spins. In another embodiment, the interaction may include activating a scatter pay, a payout multiplier, or a progressive jackpot. It should also be appreciated that the listed symbol interactions are a non-exclusive list and other suitable interactions are possible.

In some embodiments, any suitable combination of symbol interactions can be executed. For example, if multiple interacting symbols are generated and displayed on the non-interacting reel and different symbols that interact with the interacting symbols are also generated and displayed on the first set of gaming reels, the gaming system may execute two or more predetermined interactions. In one such example with a plurality of interactions, a first interaction includes changing all displayed symbols on a particular reel of the first set of reels to a different symbol. A second interaction includes triggering free spins during the game. In this example of the plurality of interactions, the different symbols on the particular reel may remain displayed or stopped while the gaming system generates and displays new symbols on the remaining reels without the different symbols, during the game.

It should be appreciated that an order of executing the combined symbol interactions does not matter in some embodiments. However, the gaming system may execute the interactions in a particular order in some embodiments. For example, the gaming system may execute symbols interactions in a particular order where executing the interactions produce a better outcome for a player.

In one embodiment, the gaming system and method includes a first set of reels and a non-interacting reel. The first set of reels includes a plurality of reels. The first set of reels is associated with a first set of symbols. The first set of symbols includes a plurality of symbols. Each reel of the first set of reels includes a plurality of symbol display areas displayed on a display of the gaming system. The first set of reels is oriented in a first way when displayed on the display of the gaming system. In one embodiment, the first set of reels is displayed in vertical orientation, like a traditional set of gaming reels. In one embodiment, the gaming system may be configured to display the first set of reels spinning in a downward direction during game play. Alternatively, the gaming system may be configured to display the first set of reels spinning in an upward direction during game play.

In one embodiment, the non-interacting reel is associated with a second set of symbols. The second set of symbols includes a plurality of symbols and at least one interacting symbol. In some embodiments, the second set of symbols may include a plurality of different interacting symbols. The non-interacting reel includes a plurality of symbol display areas displayed on the display of the gaming system. The non-interacting reel is oriented in a second way when displayed on a display of the gaming system.

In one embodiment, the non-interacting reel is oriented differently with respect to the first set of reels. In one embodiment, the non-interacting reel is displayed in horizontal orientation (e.g., substantially perpendicular to the orientation of the first set of reels). In one embodiment, the non-interacting reel is positioned (or displayed) below the first set of reels and oriented horizontally. In such one embodiment, for each reel of the first set of reels, the non-interacting reel includes an associated symbol display area. Stated another way, each symbol display area on the non-interacting reel can be associated with one of the reels of the first set of reels. When a symbol is displayed in a symbol display area on the non-interacting reel, the symbol is then also associated with same reel as the symbol display area. In one embodiment, each symbol display area on the non-interacting reel is associated with a different reel.

In one embodiment, each symbol display area of the non-interacting reel is substantially aligned with its associated reel from the first set of reels. In one embodiment, when the non-interacting reel is oriented horizontally, the gaming system may be configured to display the non-interacting reel spinning in a left to right direction during game play. In another embodiment when the non-interacting reel is oriented horizontally, the gaming system may be configured to display the non-interacting reel spinning in a right to left direction during game play.

In one embodiment, the gaming system may include two or more non-interacting reels. In one such example with two non-interacting reels, the non-interacting reels are displayed as stacked on top of each other. In one such embodiment, the gaming system will evaluate the symbols displayed on the first set of gaming reels if an interacting symbol appears in the same symbol display area of each non-interacting reels. In another embodiment with multiple non-interacting reels, an interacting symbol may appear in symbol display area of one non-interacting reel to trigger a bonus game while an interacting symbol may appear in another non-interacting reel to cause the gaming system to perform a payout multiplier on any winnings from the bonus game. In some embodiments, the symbol display area of the interacting symbol does not matter. In other embodiments, the gaming system does not execute the symbol interactions unless the interacting symbols are displayed in particular symbol display areas of the non-interacting reel.

In one example play of a game, the gaming system randomly generates and displays a plurality of symbols from the first set of symbols on a first set of reels. The gaming system also randomly generates and displays a plurality of symbols from the second set of symbols on a non-interacting reel. If the gaming system displays an interacting symbol in one of the visible symbol positions on the non-interacting reel during the play of the game, the gaming system determines which reel from the first set of gaming reels is associated with the displayed interacting symbol. The gaming system also determines if any symbols displayed on the associated reel from the first set of gaming reels should interact with the interacting symbol. If the gaming system determines that a particular symbol on the associated reel should interact with the interacting symbol, the gaming system executes a symbol interaction such as one of the symbol interactions previously discussed. The gaming system may evaluate the displayed symbol combinations to determine if any winning symbol combinations are displayed before, during, or after the gaming system executes the symbol interactions. In one embodiment, the gaming system may evaluate the displayed symbol combinations more than once during a play of a game. The gaming system updates the player's credit balance based on payouts associated with any winning symbol combinations.

It should be appreciated that when the non-interacting reel is displayed below the first set of reels, horizontally oriented with respect to the first set of reels, and each symbol display area of the non-interacting reel is substantially aligned with one of the first set of reels, players can readily see correlations between the interacting symbols and the altered game outcomes. By showing the player a clear correlation how interacting symbols can produce improved game outcomes, the non-interacting reel and interacting symbols can provide a greatly improved sense of anticipation for players in the field of gaming technology.

BRIEF DESCRIPTION OF THE DRAWINGS

FIGS. 3A and 3B illustrate one embodiment of a method of operating the gaming system.

DETAILED DESCRIPTION OF THE INVENTION

Figure 1:
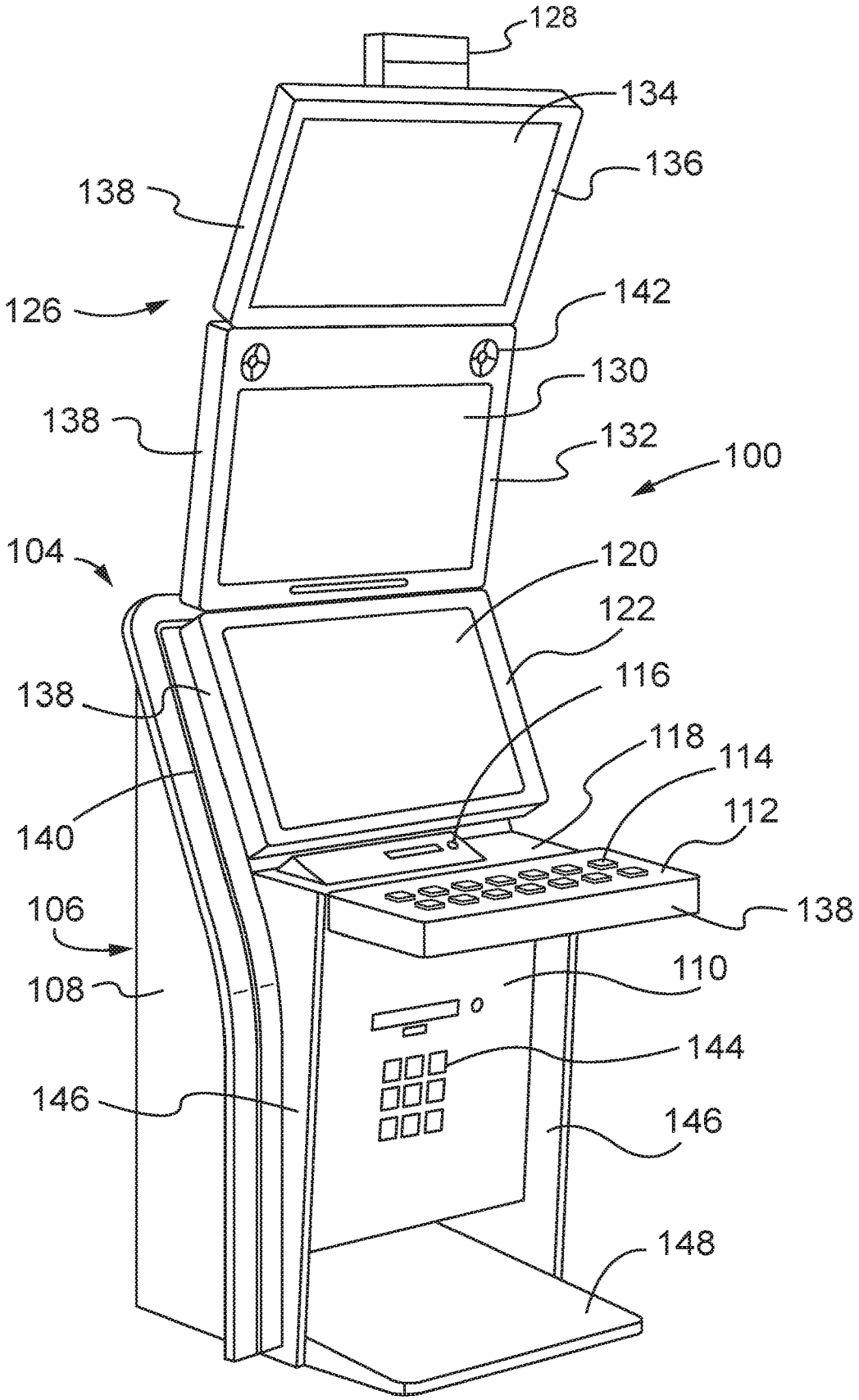
FIG. 1 is a perspective view of an embodiment of a stand-alone gaming device.

In various embodiments, a gaming system and method display a plurality of columns of symbols and at least one separate row of symbols. In one embodiment, the gaming system may evaluate the symbols displayed in the plurality of columns for winning symbol combinations without evaluating symbols displayed in the at least one separate row of symbols to determine if any winning symbol combinations are displayed. In other words, the at least one separate row of symbols is a non-interacting row. In some embodiments, the plurality of columns of symbols are formed for a first set of gaming reels that is oriented a first way and the at least one separate row of symbols is formed for a non-interacting reel that is oriented differently with respect to the first set of gaming reels.

In one embodiment, the gaming system and method may receive a monetary value through a value acceptor. The gaming system may establish a credit balance based at least in part on the received monetary value. The gaming system may receive a wager from an input device and decrease the credit balance in accordance with the amount of the wager. The gaming system may display on a display device, a plurality of symbol display areas including a first symbol display area and a second symbol display area. The gaming system may display on the display device, a first plurality of randomly determined symbols from a first set of a plurality of symbols in the first symbol display area, wherein the first plurality of randomly determined symbols are displayed in a plurality of columns. The gaming system may further display on the display device, a second plurality of randomly determined symbols from a second set of symbols in the second symbol display area, wherein the second plurality of randomly determined symbols are displayed in at least one row.

The gaming system may, with a processor, associate each of the second plurality of randomly determined symbols with one column of the plurality of columns. In one embodiment, the second plurality of randomly determined symbols further comprises at least one interacting symbol. The gaming system may determine, with the processor, if any interacting symbols are generated for display in the second plurality of randomly determined symbols. If the gaming system determines, with the processor, that an interacting symbol is displayed, the gaming system may identify a column of the plurality of columns that is associated with the displayed interacting symbol. The gaming system may determine, with the processor, if any of the displayed first plurality of randomly determined symbols in the identified column is a predetermined symbol that interacts with the displayed interacting symbol. If the gaming system determines that a predetermined symbol is displayed in the identified column, the gaming system may execute, with the processor, a game function based on the predetermined symbol and the interacting symbol. In one embodiment, the gaming function may include altering at least one of the displayed first plurality of randomly determined symbols, starting or initiating a bonus game, or other suitable gaming functions. In some embodiments, two or more gaming functions can be executed. The gaming system may determine, with the processor, any awards based on the symbols displayed in the first symbol display area and the received wager. The gaming system may display, on the display device, any determined awards and increase the credit balance by any determined awards. Upon receipt of a cash out signal via the input device, the gaming system may issue a value based on the credit balance from a value dispenser of the gaming device.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either button mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input features and locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing features of protection of/access to gaming electronics, displays, and player I/O features described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
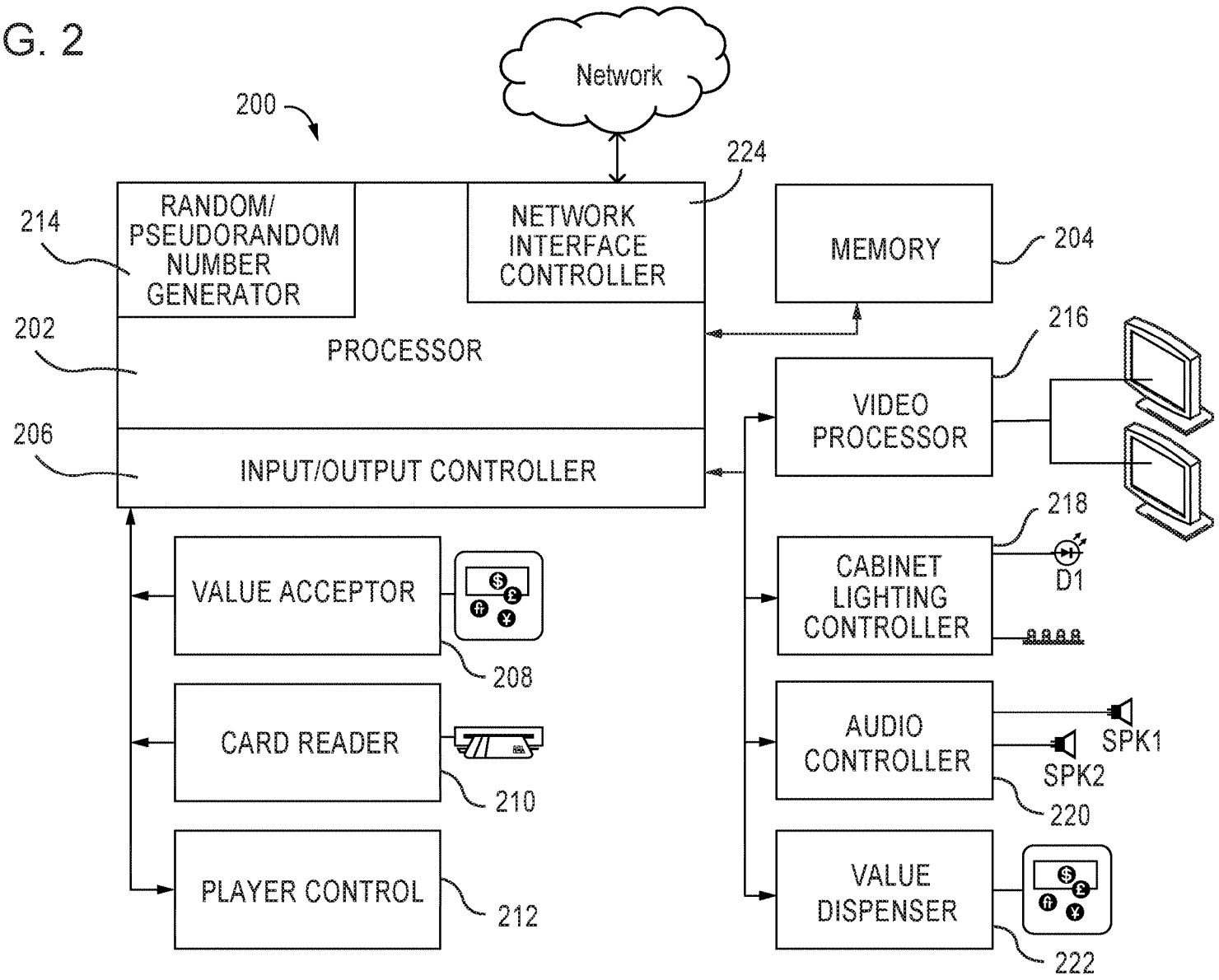
FIG. 2 is a functional block diagram of the gaming device technology components.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multicore processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, the random generation of "numbers" or symbols may be performed with electromechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The gaming device 100 can set the reels into a spinning/rotation motion based on a signal triggered by pulling a lever or pushing a button on the gaming device 100. In some embodiments, the gaming device 100 can stop the reels by the gaming device 100 actuating, on a random timing basis, a suitable mechanical or electro-mechanical reel brake. When the reels stop rotating, one or more displayed stop positions of each reel are detected. Since the stop positions are each associated with an indicia or symbol, the gaming device can determine whether the combination of displayed stop positions (i.e., translating to a combination of displayed symbols) results in one or more winning symbol combinations.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Games Including Non-Interacting Reels

FIGS. 3-8 describe some embodiments which provide a gaming system and method including at least one non-interacting reel having one or more interacting symbols.

Figure 3A:
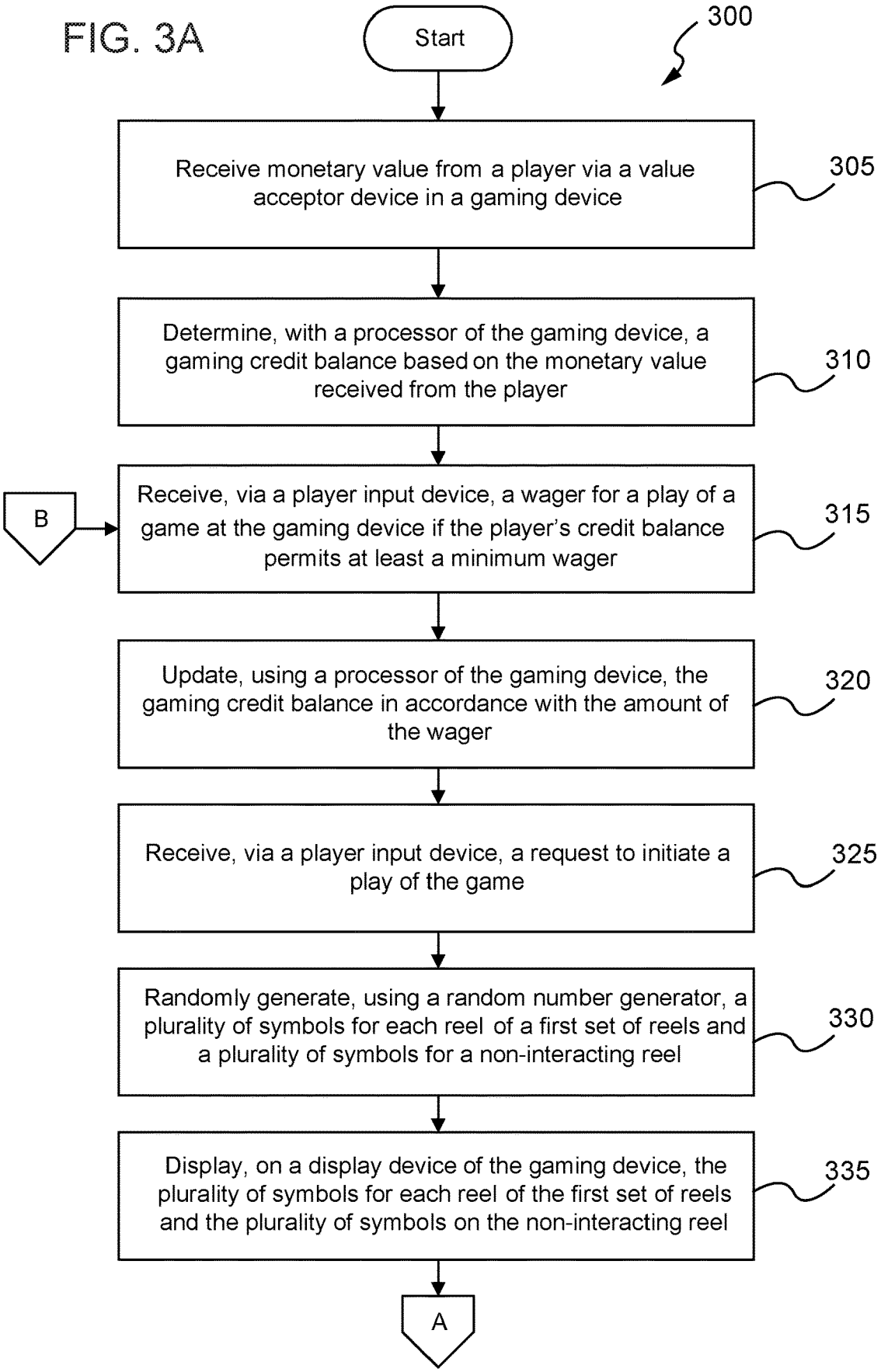

FIGS. 3A and 3B illustrate a flowchart of operation 300, which is one embodiment of the gaming system and method. In this embodiment, at least one processor of the gaming system may be configured, via instructions stored in a memory device, to perform the operation 300. However, it should be appreciated that other suitable variations of operation 300 are possible. For example, in one embodiment, fewer or one or more additional operations (not shown) may be employed in operation 300 of the gaming system and method.

FIG. 3A illustrates one embodiment in which the gaming system receives a monetary value from a player to initiate operation 300. As indicated in block 305, the gaming system may receive monetary value from a player via a value acceptor device associated with the gaming system. The value acceptor device can be any suitable value acceptor device as discussed above. The value acceptor device may also, in one embodiment, be disposed in a gaming system or in communication with the gaming system.

In one embodiment, the gaming system may determine a credit balance based on the monetary value received from the player at a value acceptor device as indicated in block 310. The gaming system may determine the gaming credit balance for the player with a processor of the gaming system. The gaming credit balance may be based at least in part on the monetary value received from the player at the value acceptor device.

In one embodiment, the gaming system may receive a wager for a play of a game at the gaming system. Block 315 of FIG. 3A illustrates one embodiment where the player's wager may be received via a player input device. The gaming system may allow a player to place a minimum wager, a maximum wager, or any suitable wager amount. Depending on the wager amount, the gaming system may also enable the player to select pay lines across displayed symbols positions on reels in the game. In one embodiment, the gaming system may determine whether the player has provided enough credits to enable the player's selected wager. The gaming system may prevent the player from placing the wager and starting a play of a game if the player's credit balance is not large enough to support the player's selected wager. If enough credits are not available in the player's credit balance, the gaming system may enable the player to insert additional value to obtain the minimum credit level for the wager or to cash out of the gaming system.

In one embodiment, the gaming system may use a processor of the gaming system to update a gaming credit balance. The credit balance may be updated in accordance with the player's wager amount as indicated in block 320. Some embodiments, the credit balance is not updated until a later time.

Block 325 illustrates one embodiment in which the gaming system may receive a request to initiate a play of a game. The request to initiate a game play may be received from a player via a player input device. For example, the player may press a spin button on the gaming system to start spinning gaming reels or to cause the gaming system to generate images for display in the game.

In one embodiment, the gaming system may use a random number generator to randomly generate a plurality of symbols for each game reel of a first set of reels as indicated in block 330. The symbols for the first set of reels may come from a first set of symbols. In one embodiment, the gaming system may also use a random number generator to randomly generate a plurality of symbols for a non-interacting reel as also indicated in block 330. The symbols for the non-interacting reel may come from a second set of symbols that includes at least one interacting symbol. As used herein, the random number generation may refer to pseudo-random or true-random number generation depending on the module used for the random number generation.

In one embodiment, the gaming system may cause a display device to display the plurality of symbols generated for the first set of reels as indicated in block 335. In one embodiment, the gaming system may also cause a display device to display the plurality of symbols for the non-interacting reel as also indicated in block 335. In some embodiments, the gaming system may always generate at least one interacting symbol for the non-interacting reel. In other embodiment, the gaming system may generate zero, one or more interacting symbols for the non-interacting reel. In one embodiment, the gaming system will associate each symbol display area of the non-interacting reel with one of the reels of the first set of reels. When the gaming system generates and displays symbols on the non-interacting reel, the displayed symbols may also each be associated with one of the reels of the first set of reels in accordance with the displayed symbols' positions on the non-interacting reel. That is, in some embodiments, a displayed symbol on the non-interacting reel will be associated with the same reel as the symbol display area where the displayed symbol is displayed.

Turning now to FIG. 3B and block 340, in one embodiment the gaming system may determine if any indicating symbols were generated and displayed on the non-interacting reel. In one embodiment, if the gaming system determines that no indicating symbols were generated and displayed in the non-interacting reel, operation 300 may proceed directly to the evaluation illustrated in block 360. It should be appreciated that the gaming system may determine if any indicated symbols were generated on the non-interacting reel prior to displaying the symbols. It should further be appreciated that the gaming system may determine if any indicated symbols were generated on the non-interacting reel at any suitable time.

In one embodiment, as illustrated in block 345, if the gaming system determines that at least one indicating symbol was generated and displayed in the non-interacting reel, the gaming system may identify which reel of the first set of reels is associated with the generated at least one indicating symbol. In other embodiments, the gaming system may determine which reel of the first set of reels is associated with a symbol display area occupied by the at least one indicating symbol to reach the same determination.

In one embodiment as illustrated in block 350, the gaming system may determine, with the processor, whether any symbols displayed on the identified reel includes a displayed symbol that interacts with the interacting symbol. In some embodiments, the symbol that interacts with an interacting symbol is predetermined. In some embodiments, the symbol that interacts with an interacting symbol is randomly determined before or during a play of the game. In some embodiments, the symbol that interacts with an interacting symbol is selected from the first set of symbols. In some embodiments, the symbol that interacts with the interacting symbol is selected of a subset of the first set of symbols. In some embodiments, different symbols will interact differently with the interacting symbol. Any suitable combinations of the above symbol interactions can be used.

If no symbols displayed on the identified reel include a symbol that interacts with the interacting symbol, the gaming system may move to block 360. On the other hand, if at least one symbol displayed on the identified reel is determined to interact with the interacting symbol, the gaming system may execute, with a processor, a game function based on the interaction between the two symbols in accordance with block 355. In one embodiment, the interaction may include the gaming system causing one displayed symbol on the identified reel of the first set of reels to change all the other displayed symbols on the same identified reel into the symbol determined to interact with the interacting symbol. In another embodiment, the symbol interaction may include triggering a bonus game or a predetermined number of free spins. The gaming system may also use the processor to determine any of the alterations to the symbols in the first set of symbols based on the interaction. It should be appreciated that the gaming system can execute any suitable interaction.

The gaming system may evaluate, in one embodiment, the displayed symbol combinations on the first set of reels for winning symbol combinations as indicated in block 360. The availability of certain winning symbol combinations may be based on the amount the player wagered in block 315. In one embodiment, the game system may evaluate one or more pay lines via a processor of the gaming system. In this example embodiment, the gaming system may determine an award amount based on winning symbol combinations that are formed along wagered pay lines.

Block 362 illustrates one embodiment in which the gaming system may update, with a processor of the gaming system, the gaming credit balance in accordance with any award amount determined in block 360.

In one embodiment, after receiving a signal to end game play from a player via an input device as illustrated in block 365, the gaming system may dispense the gaming credit balance to the player via a value dispenser, as indicated in block 362. In one embodiment, if the processor has not received a signal to end game play via a player input device, the process of operation 300 may return to block 315 to receive another wager for another play of a game at the gaming system. However, in one embodiment, the wager may not be accepted if the player's credit balance includes less credits than the player's selected wager amount.

FIGS. 4A, 4B, 4C, and 4D illustrate screen shots of one embodiment of a gaming system having a non-interacting reel and one or more interacting symbols.

Figure 4A:
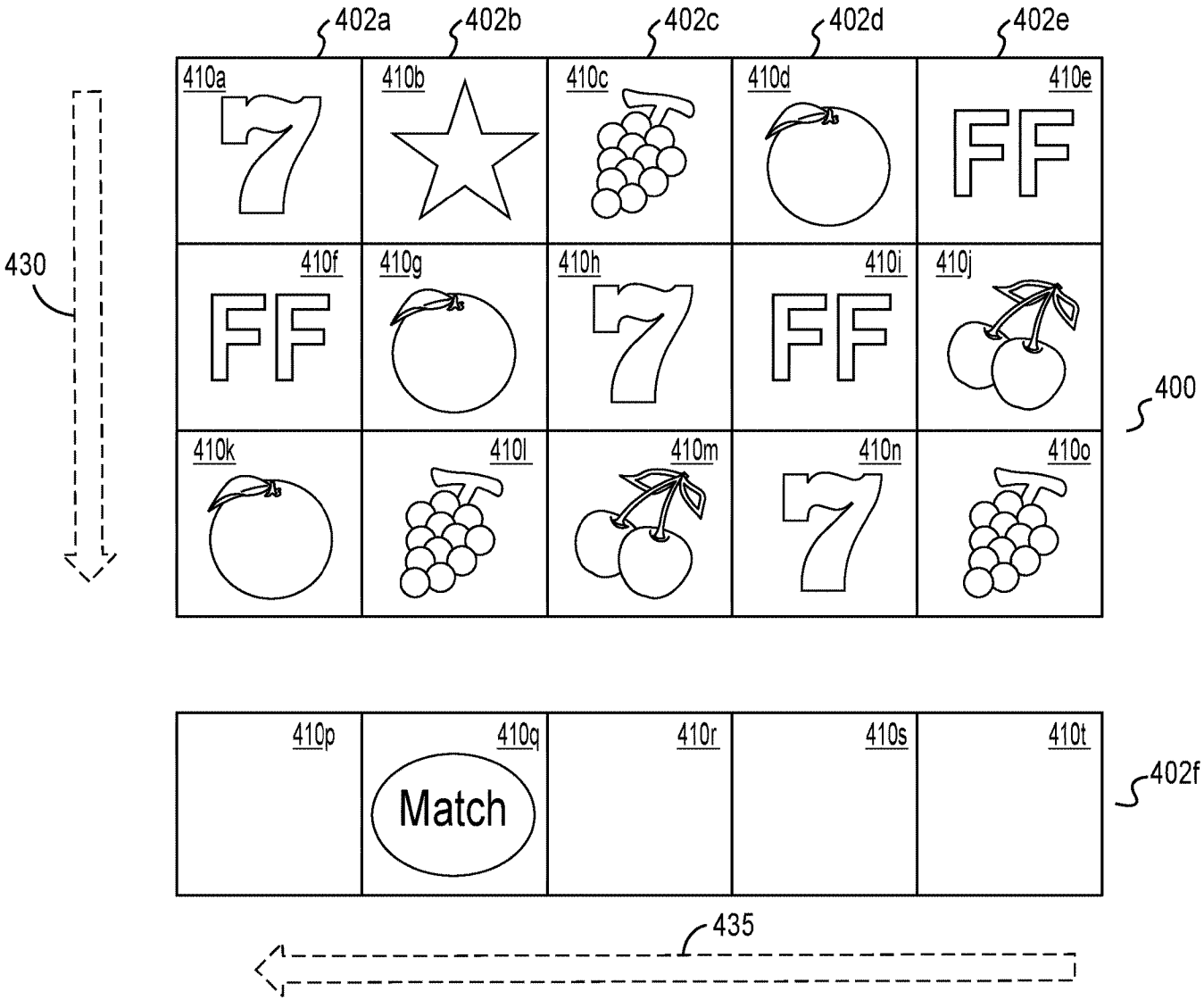
FIGS. 4A, 4B, 4C, and 4D illustrate screen shots of an example embodiment of a gaming system having a non-interacting reel and an interacting symbol.

FIG. 4A illustrates one embodiment of a game display 400 that is displayed by the gaming system on a display device of the game device 100. In one embodiment, game display 400 may be displayed on first display 122 of gaming device 100 illustrated in FIG. 1. However, any other suitable display may be used. The game display 400 displays a set of a plurality of reels 402*a*, 402*b*, 402*c*, 402*d*, 402*e*, and 402*f* as illustrated in FIG. 4A. As also illustrated in FIG. 4A, the reels 402*a*-402*e* are displayed substantially side by side, while reel 402*f* is depicted as separated from and positioned below reels 402*a*-402*e*. It should be appreciated that reel 402*f* can be displayed substantially close with reels 402*a*-402*e* in some embodiments where little to no separation is discernable. In such examples, the gaming system may be configured to display some indication that enables a player to discern a difference between reel 402*f* and reels 402*a*-402*e*. It should be appreciated that reels 402*a*-402*f* can alternatively be displayed with any suitable amount of separation or no separation.

The plurality of reels 402*a*-402*e* are each associated with a first set of symbols, where the first set of symbols includes a plurality of symbols. Each reel 402*a*-402*e* is associated with a plurality of symbols of the first set of symbols. Each reel 402*a*-402*e* can also be associated with the same or a different plurality of symbol combinations from the first set of symbols. Reel 402*f* is associated with a second set symbols, where the second set of symbols includes at least one interacting symbol.

The first set of symbols may include numbers, letters, geometric figures, symbols, images, character, blank symbols (e.g., the absence of symbols), animations, or any other suitable graphical depiction. In one embodiment, the second set of symbols includes at least one interacting symbol such as a directional arrow. However, it should be appreciated that the second set of symbols may also include any suitable symbol such as numbers, letters, geometric figures, symbols, images, character, blank symbols (e.g., the absence of symbols), animations, or any other suitable graphical depiction.

Symbols in the first set of symbols may be associated with special features. These special features may trigger the gaming system to perform a particular function when such symbols are visibly displayed on a stopped reel. In one example, the appearance of a symbol designated to trigger a bonus game may cause the gaming system to execute a bonus game during or after a play of a game. In another example, the appearance of a symbol designated to trigger free spins may cause the gaming system to execute a certain number of free spins. In another example, one of the symbols in the first set of symbols can be a Flipside Frenzy symbol such as symbol 420*k* shown in FIG. 4B. The Flipside Frenzy symbol is a type of wild symbol that can mimic or substitute for any of the other plurality of symbols of the first set of symbols. That is, the appearance of a Flipside Frenzy symbol on a stopped reel may cause the gaming system to evaluate the Flipside Frenzy symbol like one of the other symbols along a wagered pay line for purposes of determining a winning symbol combination. In another embodiment, the gaming system may cause the Flipside Frenzy symbol to flip or turn a predetermined number of degrees (e.g., approximately 180 degrees or other suitable number of degrees) to reveal a different symbol. In such an embodiment, the different symbol may cause the gaming system to change certain other visible symbols around the different symbol into the different symbol. In another embodiment, gaming system may cause other visible symbols on the reel displaying the Flipside Frenzy symbol to change into the Flipside Frenzy symbol. In some embodiments, the gaming system does not execute any functions associated with the Flipside Frenzy symbol unless another predetermined symbol is visibly displayed. For example, the gaming system may not execute any described functions associated with the Flipside Frenzy symbol unless an interacting symbol is visibly displayed on reel 402*f*. In one such embodiment, the interacting symbol must appear in a symbol display position associated with the column or reel displaying the Flipside Frenzy symbol before the gaming system will execute any functions associated with the Flipside Frenzy symbol.

In one embodiment, an interacting symbol is a symbol that can identify a column or reel of visible symbols. The appearance of an interacting symbol can identify to a player and the gaming system that certain interactions may occur between an interacting symbol and symbols in a column or reel associated with the interacting symbol. For example, an interacting symbol 420*p* (the match symbol) indicates the first column or reel 402*a* in FIG. 4B. Based on an association between the interacting symbol 420*p* and reel 402*a*, the gaming system may evaluate the symbols along this reel or column to determine if any symbols will interact with interacting symbol 420*p* (which may cause the gaming system to execute additional game functions). For example, the gaming system may be specially programmed to cause symbol 420*f* and 420*a* of reel 402*a* in FIG. 4B to convert into a Flipside Frenzy symbol because the Flipside Frenzy symbol 420*k* appeared in the reel 402*a* which is associated with interacting symbol 420*p* (or symbol display area 410*p*). In one example, the Flipside Frenzy symbol may interact with the match symbol 420*p* to cause the Flipside Frenzy symbol to overwrite or replace symbols 420*a* and 420*f*. On the other hand, as shown in FIG. 4A, while a Flipside Frenzy symbol is also displayed in symbol display area 410*e*, if the Flipside Frenzy symbol is not in a column or reel associated with a match symbol (symbol display area 410*t* is a blank symbol), the gaming system may determine not to change symbols 420*j* and 420*o* into Flipside Frenzy symbols.

In other embodiments, symbols other than the Flipside Frenzy symbol can be used in conjunction with the interacting symbol for the same or other interactions and cause the gaming system to execute additional game functions. In still other embodiments, the interacting symbol may indicate a column or reel as well as a type of action to perform based upon the content displayed in the interacting symbol. For example, the content of the interacting symbol may include a payout multiplier. The gaming system may use the payout multiplier to determine how many credits the player will win. In another example, the interacting symbol may include a number as the content. The number displayed with the interacting symbol may determine how many symbols in a reel the Flipside Frenzy symbol can change. Various game operation embodiments are described in greater detail below.

Returning now to FIG. 4A, the game display 400 depicts a plurality of symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o*, 410*p*, 410*q*, 410*r*, 410*s*, and 410*t*. These plurality of symbol display areas can be associated in a manner that provides the appearance of game reels. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a first set of five game reels. In one embodiment, the plurality of symbol display areas that provide the appearance of five game reels may be arranged in a manner that visibly shows three symbol positions of each of the five game reels. For example, the symbol display areas 410*a*-4010 are each associated with positions on reels 402*a*-402*e*. The symbol display areas 410*p*-401*t* are associated with positions on reel 402*f*. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; symbol display areas 410*d*, 410*i*, and 410*n* are associated with reel 402*d*; symbol display areas 410*e*, 410*j*, and 410*o* are associated with reel 402*e*; and symbol display areas 410*p*, 410*q*, 410*r*, 410*s*, and 410*t* are associated with reel 402*f*. The arrangement illustrated in the embodiment of FIG. 4A thus creates a first visible display area of the reels 402*a*-402*f* comprising three visible symbol positions for each reel. When viewed together, reels 402*a*-402*e* appear like a 3-row by 5-column reel array in display 400 and reel 402*f* appears like a 1-row by 5 column reel array in display 400. In other embodiments, smaller or larger visible areas of the reels can be displayed. That is, the reels 402*a*-402*f* may show a fewer number of visible symbols or show a larger number of visible symbols for the reels. While symbol display areas are illustrated with defined areas or boxes, it should be appreciated that in some embodiments, the defined areas or boxes are not visible to the player.

Each reel 402*a*-402*e* may display a plurality of symbols from the first set of symbols in their respective symbol display areas as illustrated in FIG. 4A. Reel 402*f* may display one or more symbols from the second set symbols in its symbol display areas illustrated in FIG. 4A. As shown in FIG. 4A, during a play of a game, each reel 402*a*-402*e* may show an animation of spinning reels spinning in the direction indicated by arrow 430 and reel 402*f* may show an animation of a spinning reel spinning in the direction indicted by arrow 435.

In some embodiments, the symbol display areas of reel 402*f* are each associated with at least one column or reel, such as reels 402*a*-402*e*. For example, in FIG. 4A, the gaming system may associate symbol display area 410*p* with reel 402*a*; the gaming system may associate symbol display area 410*q* with reel 402*b*; the gaming system may associate symbol display area 410*r* with reel 402*c*; the gaming system may associate symbol display area 410*s* with reel 402*d*; and the gaming system may associate symbol display area 410*t* with reel 402*e*. Thus, in one embodiment, the association is easy to visualize because the symbol display areas of reel 402*f* line up substantially with reels 402*a*-402*e*. In other embodiments, the gaming system may randomly determine how the symbol display areas of reel 402*f* will be associated with each of the reels 402*a*-402*e*. When symbol display areas 410*p*-410*t* of reel 402*f* display symbols, these displayed symbols may also be associated with the same column or reel as their corresponding symbol display areas 410*p*-410*t*.

FIG. 4A illustrates one embodiment of display are 400 showing a game screen prior to executing a play of a game with a plurality of symbols generated for reels 402*a*-402*e* and a plurality of symbols generated for reel 402*f*.

Figure 4B:
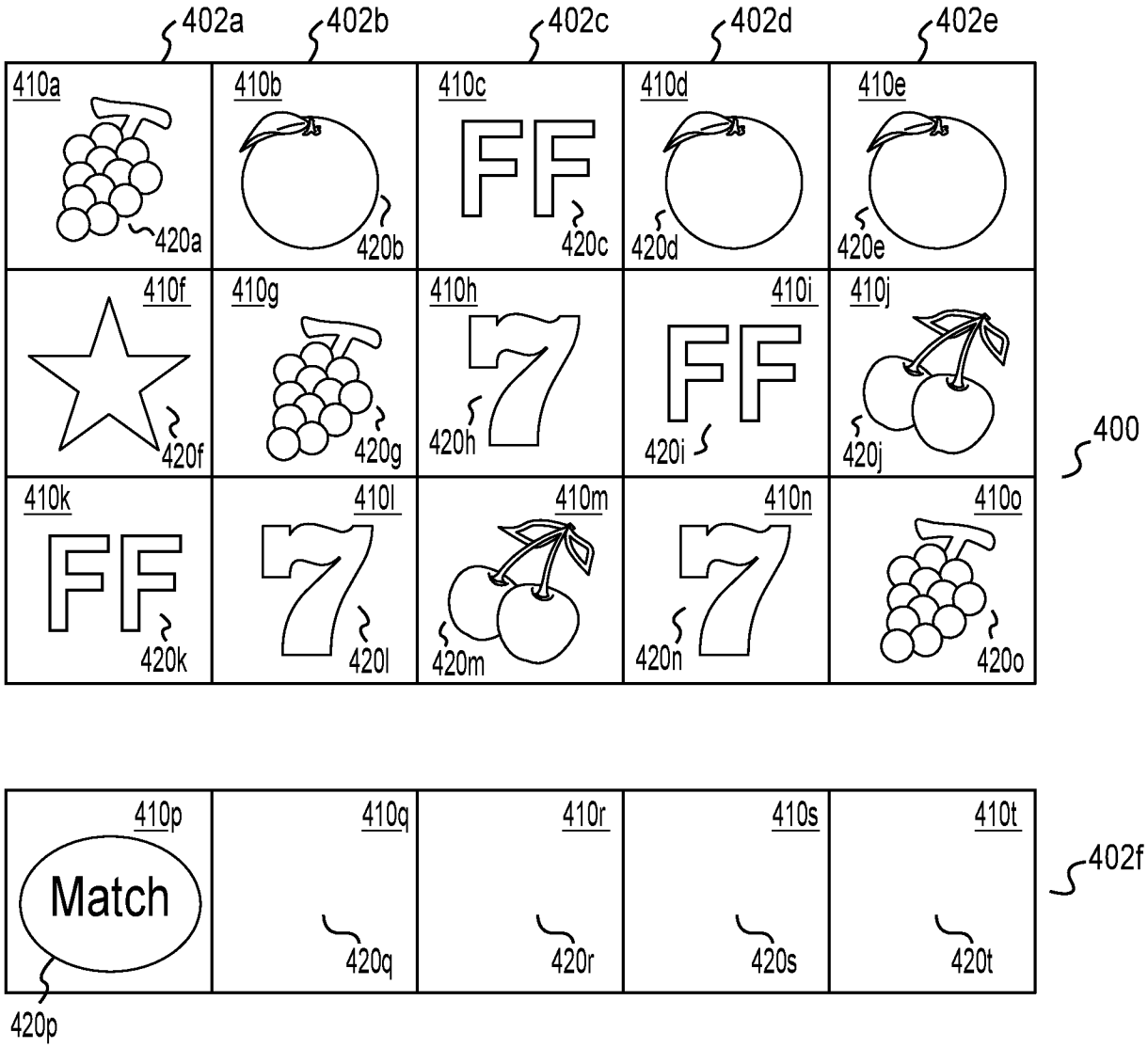

Turning now to FIG. 4B, to start a gaming session, a player provides the gaming system with a deposit of value, using one of the suitable value acceptor devices described above. The gaming system receives and validates the player's deposit of value. The gaming system may then issue credits (e.g., gaming credits) to the player based on the received value. The credits enable the player to initiate a play of a game and also to place wagers on a play of the game. The gaming system may provide a visual indication of the player's credit balance to the player as discussed above.

To initiate of a play of a game, the player presses one or more appropriates buttons on the gaming system to deduct credits necessary to play the game and to identify the player's wager. Along with receiving the player's wager, the gaming system may receive pay lines selections or other game features the player wishes to activate in exchange for the wager. The player may actuate a game start button or a spin button, depending on the type of game played. The gaming system may deduct the appropriate credits from the player's credit balance after the player's wager or at any suitable time.

Upon receipt of the player's wager and activation of the game start button, the gaming system may show an animation of spinning reels as indicated by direction arrows 430 and 435 of FIG. 4A for each of the reels 402*a*-402*f*. In one embodiment, the gaming system randomly generates symbols 420*a*-420*r* from the first and second set of symbols for reels 402*a*-402*f*, respectively. As noted above, the gaming system may rely on random number generation performed by a pseudo RNG, a true RNG, or other hardware RNGs. The gaming system displays the generated symbols 420*a*-420*t* in symbols display areas 410*a*-410*t* as illustrated in FIG. 4B. Symbols 420*a*-420*r* displayed on reels 402*a*-402*f* illustrate the randomly generated symbols after the reels have stopped spinning. It should be noted that in some embodiments, the reel spin directions may both be reversed from the shown directions or just one reel spin direction may be reversed.

As illustrated in FIG. 4B, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*. The gaming system further randomly generated and displayed symbols 420*p*, 420*q*, 420*r*, 420*s*, 420*t* in symbol display areas 410*p*, 410*q*, 410*r*, 410*s*, 410*t* for reel 402*f*.

As illustrated in FIG. 4B, the gaming system generated and displayed an interacting symbol 420*p* and blank symbols 402*q*-420*t* for reel 402*f* (a non-interacting reel). As also illustrated in FIG. 4B, the gaming system generated and displayed Flipside Frenzy symbols (420*k*, 420*c*, 420*i*), orange symbols (420*b*, 420*d*, and 420*e*), grape symbols (420*a*, 420*g*, and 420*o*), cherry symbols (420*j* and 420*m*), and seven symbols (420*h*, 420*l*, and 420*n*). However, is should be appreciated that the displayed symbol combinations are merely for explanatory purposes and the gaming system may randomly generate any suitable combination of symbols based on defined symbol sets and the random number generation.

In one embodiment of FIG. 4B, the gaming system performs an evaluation of the generated symbols on reels 402*a*-402*f* and determines whether to execute certain game functions based in part on interactions between symbols. In one embodiment, the gaming system determines whether any interacting symbols were generated and displayed in reel 402*f*. In the illustrated embodiment of FIG. 4B, the gaming system determines that a Match symbol 420*p* (an interacting symbol), was generated and displayed in position 410*p* of reel 402*f*. The gaming system may then determine which reel or column of symbols is associated with the interacting symbol 420*p* (or symbol display area 410*p*). The association between the interacting symbol (or symbol display area) and a reel determines which displayed symbols the gaming system will evaluate to determine what interactions (if any) the gaming system may execute.

In the embodiment illustrated in FIG. 4B, the gaming system determines that interacting symbol 420*p* is associated with reel 402*a*. Based at least in part on this determination, the gaming system determines if any of the symbols 420*a*, 420*f*, or 420*k* interacts with the interacting symbol 420*p*. While depicted in FIG. 4B as a match symbol, an interacting symbol 420*p* can be any other suitable symbol or graphic. In one embodiment, the interacting symbol can be an arrow graphic that points to the first reel 402*a*. It should be appreciated that the association between the interacting symbol 420*p* and the reel provides a clear acknowledgment to a player that the gaming system may evaluate and possibly execute game functions on the first reel of the visible symbols on reels 402*a*.

For example, the gaming system may be specially programmed to cause symbol 420*f* and 420*a* of reel 402*a* in FIG. 4B to convert into a Flipside Frenzy symbol because the Flipside Frenzy symbol 420*k* appeared in the reel 402*a* which is associated with interacting symbol 420*p* (or symbol display area 410*p*). Alternatively, the Flipside Frenzy symbol may interact with the match symbol 420*p* to cause the Flipside Frenzy symbol to overwrite or replace symbols 420*a* and 420*f*. On the other hand, as shown in FIG. 4B, while a Flipside Frenzy symbol is also visibly displayed in symbol display area 410*c*, if the Flipside Frenzy symbol is not in a column or reel associated with a match symbol (symbol display area 410*r* is a blank symbol), the gaming system may determine not to change symbols 420*h* and 420*m* into Flipside Frenzy symbols.

In one embodiment, the gaming system determines (such as using processor 202) that the first reel 402*a* includes a Flipside Frenzy symbol 420*k* and also determines that a Flipside Frenzy symbol 420*k* interacts with the interacting symbol 420*p*. In this embodiment, the Flipside Frenzy symbol interacts with the interacting symbol 420*p* to cause the gaming system to change the behavior of symbols around the Flipside Frenzy symbols. As previously discussed, many other interactions are possible.

Figure 4C:
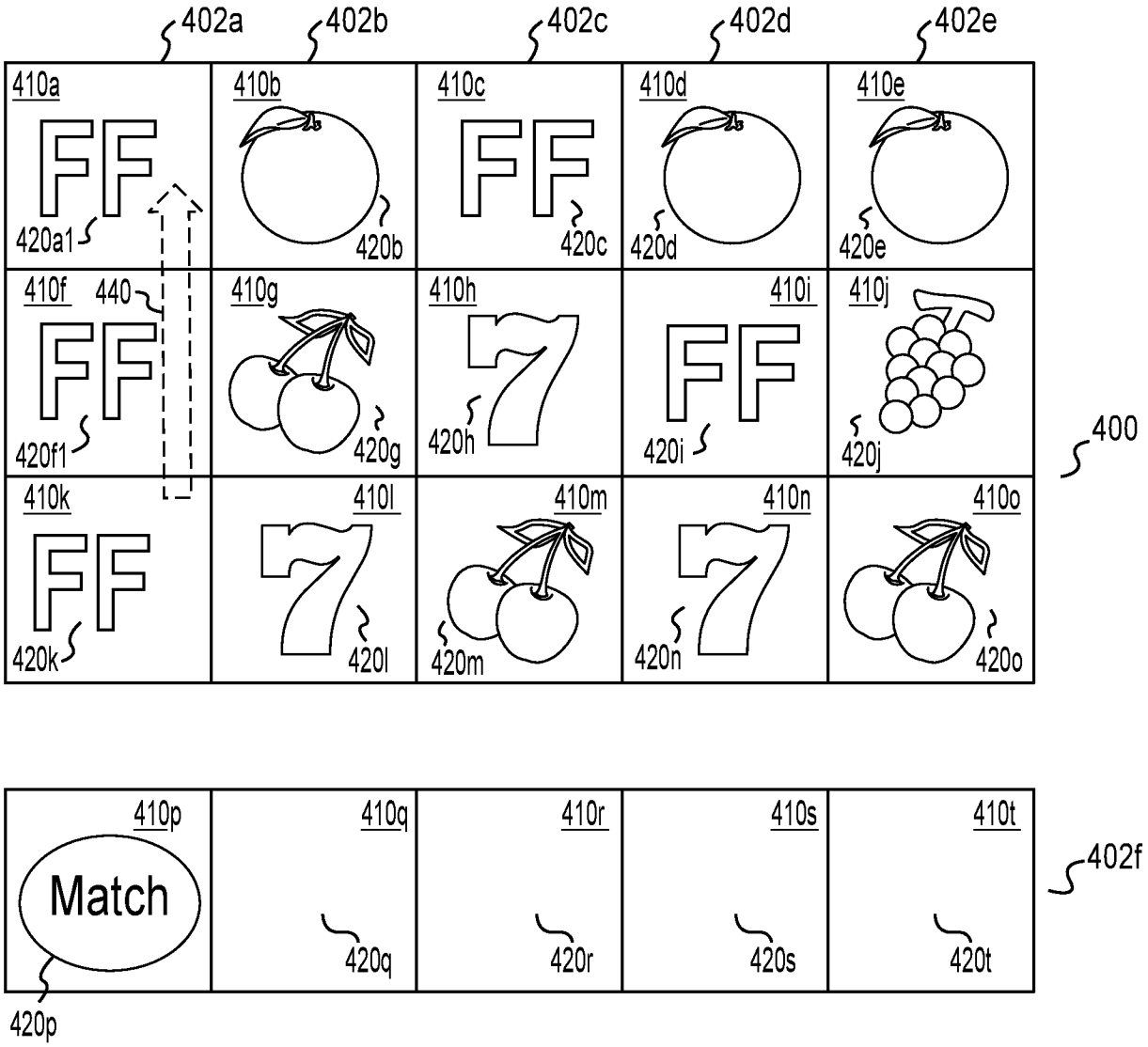

In the embodiment illustrated in FIG. 4C, the gaming system causes the Flipside Frenzy symbols 420*k* to expand in the direction of dotted arrow 440 to the remaining visible symbols positions on reels 402*a*. As is illustrated in FIG. 4B, a Flipside Frenzy symbol 420*a*1 and 420*f*1 have expanded to symbol positions 410*a* and 410*f* on reel 402*a* and replaced the prior symbols 420*a* and 420*f*. In some embodiments, the gaming system may execute the same or different game functions based on interactions between other symbols. For example, the gaming system may execute a bonus game or a free spin based on some symbol interactions. The gaming system may execute additional game functions at the same time, in a random order, or in a particular sequence.

While the illustrations in the figures of the disclosure show symbols expanding to other symbol positions and replacing the existing symbols, other symbol interactions may be used in place of the expanding symbol shown in FIG. 4C. For example, the Flipside Frenzy symbol may grow into other symbol positions. In some embodiments, the symbol in a symbol position that is slated for transformation may morph into the Flipside Frenzy symbol. In some embodiments, the Flipside Frenzy symbol only impacts or changes predetermined base symbols. In some such embodiments, scatter pay, bonus game triggering symbol, free spin symbols, and other symbols associated with certain special game features are not affected by the Flipside Frenzy symbol interaction. That is, in these embodiments, scatter pay and other such symbols associated with special game features will not be replaced whether through expansion, growth, morphing, or other suitable changes, while base game symbols are affected. In other embodiments, the Flipside Frenzy symbol interaction can change all symbols without regard to a symbol's association with special game features.

In yet other embodiments, the Flipside Frenzy symbols may also transform into one or more different symbols based on an interaction with the interacting symbols. The transformation may include animating the Flipside Frenzy symbol in such a manner as to appear to spin about an axis or flip sides to a different symbol.

It should be appreciated that the ability to alter the behavior of the Flipside Frenzy symbol and other symbols is not limited to the Flipside Frenzy symbol. Any suitable symbol can be designated to perform similar game functions noted herein when interacting with an interacting symbol. It should also be appreciated that the gaming system can also be specially configured to execute other interactions between symbols to increase a player's anticipation of increased awards and further increase the player's enjoyment of the game.

If the gaming system determines that no other symbols in reel 402*a* interact with symbol 420*p*, the gaming device may evaluate the displayed symbol combinations for winning symbol combinations. It should be appreciated that the gaming device can evaluate the displayed symbols for winning combinations at any time. For example, the game system may evaluate the displayed symbols for winning combinations after the gaming system initially generated the symbols and before the gaming system allows the symbols to interact with other symbols. The gaming system may alternatively evaluate the displayed symbols at other predetermined intervals during a play of the game.

Figure 4D:
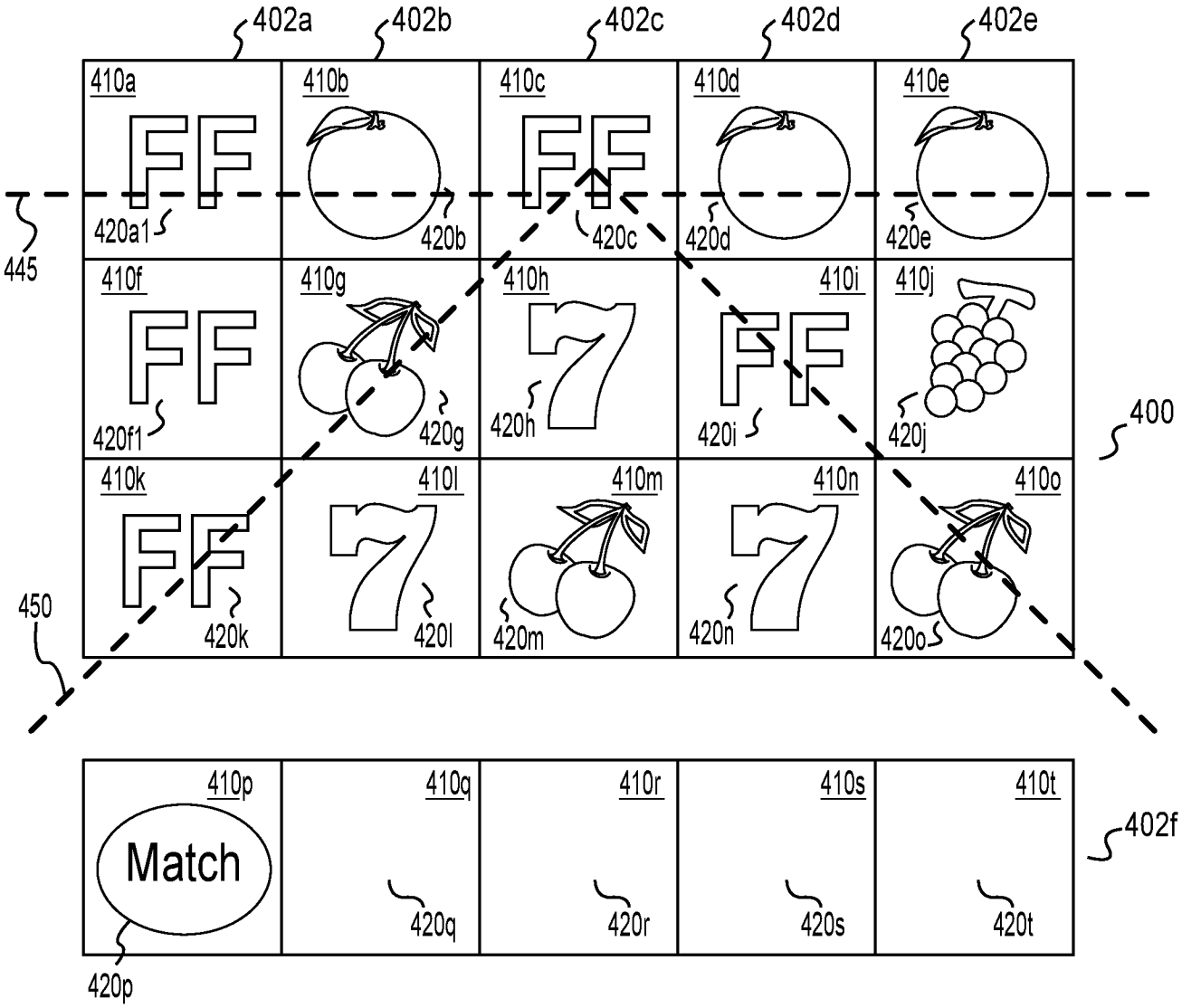

FIG. 4D illustrates one embodiment gaming system executing an evaluation of the displayed symbol combinations for winning symbol combinations. As noted above, the player may have wagered on one or more pay lines, which will then be evaluated for winning symbol combinations. Any suitable number of pay lines may be used to evaluate winning symbol combinations. While FIG. 4D shows two pay lines for evaluation, other figures in the disclosure illustrate some of the many alternative pay line evaluations that are possible. Not all pay line alternatives are illustrated in the figures.

In the embodiment illustrated in FIG. 4D, the gaming system evaluated one winning pay line across a horizontal direction of symbol display areas including symbol display areas 410*a*, 410*b*, 410*c*, 410*d*, and 410*e*. In this embodiment, five orange symbols across a pay line results in a winning symbol combination. While only three orange symbols 420*b*, 420*d*, and 420*e* are present across the first row of reels 402*a*-402*e*, the Flipside Frenzy symbols take on the characteristics of the orange symbols 420*b*, 420*d*, and 420*e*. Thus, symbols 410*a*, 410*b*, 410*c*, 410*d*, and 410*e* would be evaluated as all orange symbols for purposes of the gaming system determining winning symbol combinations. The winning pay line is illustrated as pay line 445 in FIG. 4D across the winning row of reels 402*a*-402*e*.

In the embodiment illustrated in FIG. 4D, the gaming system also evaluated another winning pay line across another direction of the symbol display areas including symbol display areas 410*k*, 410*g*, 410*c*, 410*i*, and 410*o*. In this embodiment, five cherry symbols across a pay line results in a winning symbol combination. While only two cherry symbols 420*g* and 420*o* are present across pay line 450, the Flipside Frenzy symbols for this pay line take on the characteristics of the cherry symbols 420*g* and 420*o*. Thus, symbols 420*k*, 420*g*, 420*c*, 420*i*, and 420*o* would be evaluated as all cherry symbols for purposes of the gaming system determining winning symbol combinations. The winning pay line is illustrated as pay line 450 in FIG. 4D across the winning row of reels 402*a*-402*e*.

As previously noted, in some embodiments, the gaming system evaluates symbol combinations across reels 402*a*-402*e* for winning symbol combinations without evaluating symbols displayed in the non-interacting reel 402*f*.

Based on the winning symbol combination along the pay lines 445 and 450, the gaming system awards the appropriate number of credits to the player and updates the player's credit meter to reflect the winnings. The gaming system may display the number of winning credits and may display the player's total credit balance in a display of the gaming system.

The player may continue the gaming session by playing another game. That is, the player may place a wager and start a new play of the game as noted above. However, continued game play is dependent on the number of credits the player has in the player's credit balance. The player may also choose to cash out. In such an instance, the gaming system provides the player a value based on the player's credit balance using any of the value items discussed above (bills, coins, vouchers, etc.)

From FIGS. 4B-4D, it should be noted that prior to the addition of the Flipside Frenzy symbols 420*f*1 and 420*a*1, only one symbol combination was present on any pay lines that would have formed a winning symbol combination from the initially generated symbols on reels 402*a*-402*e* (as illustrated in FIG. 4B). However, the game resulted in an additional winning symbol combination for the player due to the interacting symbol 420*p* and the appearance of Flipside Frenzy symbol in the associated reel 402*a*. Interacting symbol 420*p* and the Flipside Frenzy symbol on reel 402*a* interacted to change the other visible symbols on reel 402*a* and improve the player's winning outcome.

It should be appreciated that in some embodiments, the gaming system may be configured to evaluate the winning symbol combinations before, during, or after the interacting symbols interact with other displayed symbols. In some embodiments, the gaming system may not change generated symbols due to the interacting symbols. In one example embodiment, if the gaming system determines that changing the generated symbols would result in an equal or worse outcome than the outcome from the initially generated symbols, the gaming system may not change the generated symbols. For example, if the gaming system determines that changing the other symbols to Flipside Frenzy symbols (or executing other game functions based on other symbol interactions) would result in an equal or worse outcome than the outcome from the initially generated and displayed symbols, the gaming system may not cause the other symbols to change to Flipside Frenzy symbols as discussed above. In some embodiments, the gaming system may prevent the other symbols from being altered. In other embodiments, the gaming system may alter the other symbols to Flipside Frenzy symbols, but then revert the altered symbols to the originally generated symbols when the originally generated symbols would produce a better winning combination of symbols. In yet other embodiments, the gaming system may enable the player to select either the initially generated and displayed symbol combination or the displayed symbol combination altered based on the interacting symbols. In such an embodiment, the gaming system would evaluate the player selected displayed symbol combination for purposes of determining winning symbol combinations and credit awards. In one such embodiment, the gaming system enables the player to make the selection prior to displaying the altered symbol combinations.

FIGS. 5A, 5B, 5C, and 5D illustrate screen shots of one embodiment of a gaming system having a non-interacting reel and a plurality of interacting symbols. In some embodiments, the gaming system will generate a plurality of interacting symbols for some or each play of a game. For example, the gaming system may generate a plurality of interacting symbols if the player is in a free spin game or if the player has entered a bonus game. In other embodiments, the gaming system may generate a plurality of interacting symbols in a base game.

Figure 5A:
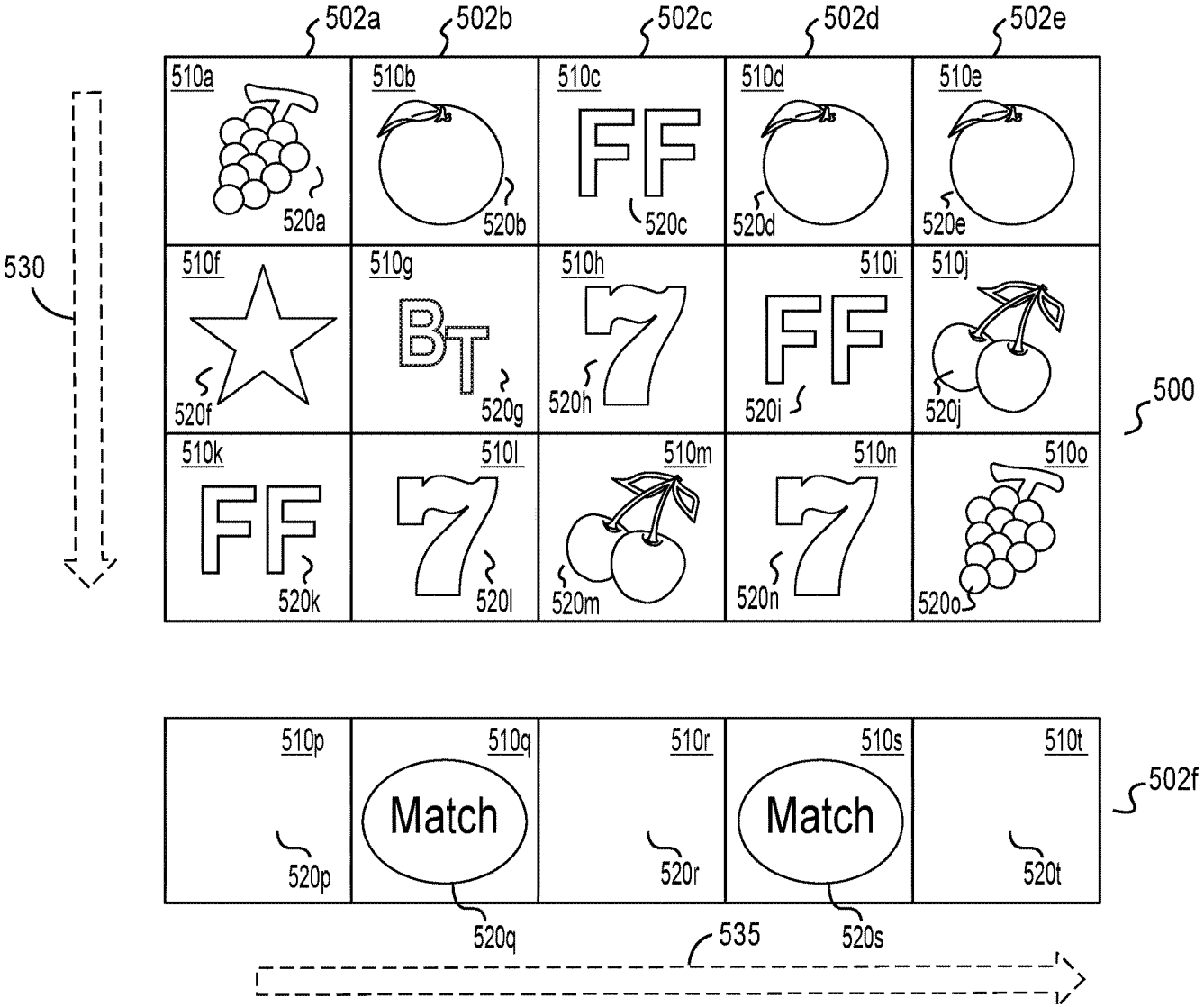
FIGS. 5A, 5B, 5C, and 5D illustrate screen shots of another example embodiment of a gaming system having a non-interacting reel and a plurality of interacting symbols.

In FIG. 5A the player has wagered on a play of a base game and the gaming system executed the game in a manner similar to the process discussed in connection with FIGS. 4A-4D. As illustrated in FIG. 5A, the gaming system shows a display of a plurality of symbols from a first set symbols on reels 502*a*-502*e* and a second set of symbols on reel 502*f*. The gaming system randomly generated the symbols and displayed the symbols as previously described. Stopped reels 502*a*-502*e* contains symbols 520*a*-520*o* in symbol display areas 510*a*-510*o*, respectively. As also illustrated in FIG. 5A, stopped non-interacting reel 502*f* displays a plurality of interacting symbols 520*p*-520*t* in symbol display areas 510*p*-510*t*.

As illustrated in FIG. 5A, the gaming system randomly generated and displayed symbols 520*a*, 520*f*, and 520*k* in symbol display area 510*a*, 510*f*, and 510*k* for reel 502*a*. The gaming system also randomly generated and displayed symbols 520*b*, 520*g*, and 520*l* in symbol display areas 510*b*, 510*g*, and 510*l* for reel 502*b*; symbols 520*c*, 520*h*, and 520*m* in symbol display areas 510*c*, 510*h*, and 510*m* for reel 502*c*; symbols 520*d*, 520*i*, and 520*n* in symbol display area 510*d*, 510*i*, and 510*n* for reel 502*d*; and symbols 520*e*, 520*j*, and 520*o* in symbol display area 510*e*, 510*j*, and 510*o* for reel 502*e*. The gaming system further randomly generated and displayed symbols 520*p*, 520*q*, 520*r*, 520*s*, and 520*t* in symbol display area 510*p*, 510*q*, 510*r*, 510*s*, and 510*t* for reel 502*f*.

As also illustrated in FIG. 5A, the gaming system generated and displayed Flipside Frenzy symbols (520*k*, 520*c*, 520*i*) among other symbols in reels 502*a*, 502*c*, and 502*d*. The gaming system also generated and displayed a Bonus Trigger (BT) symbol 520*g* among other symbols in reel 502*c*. The gaming system further generated and displayed interacting symbols 520*q* and 520*s* for reel 502*f*. It should be appreciated that the displayed symbol combinations are merely for explanatory purposes and the gaming system may randomly generate any suitable combination of symbols based on defined symbol sets as previously discussed.

Figure 5B:
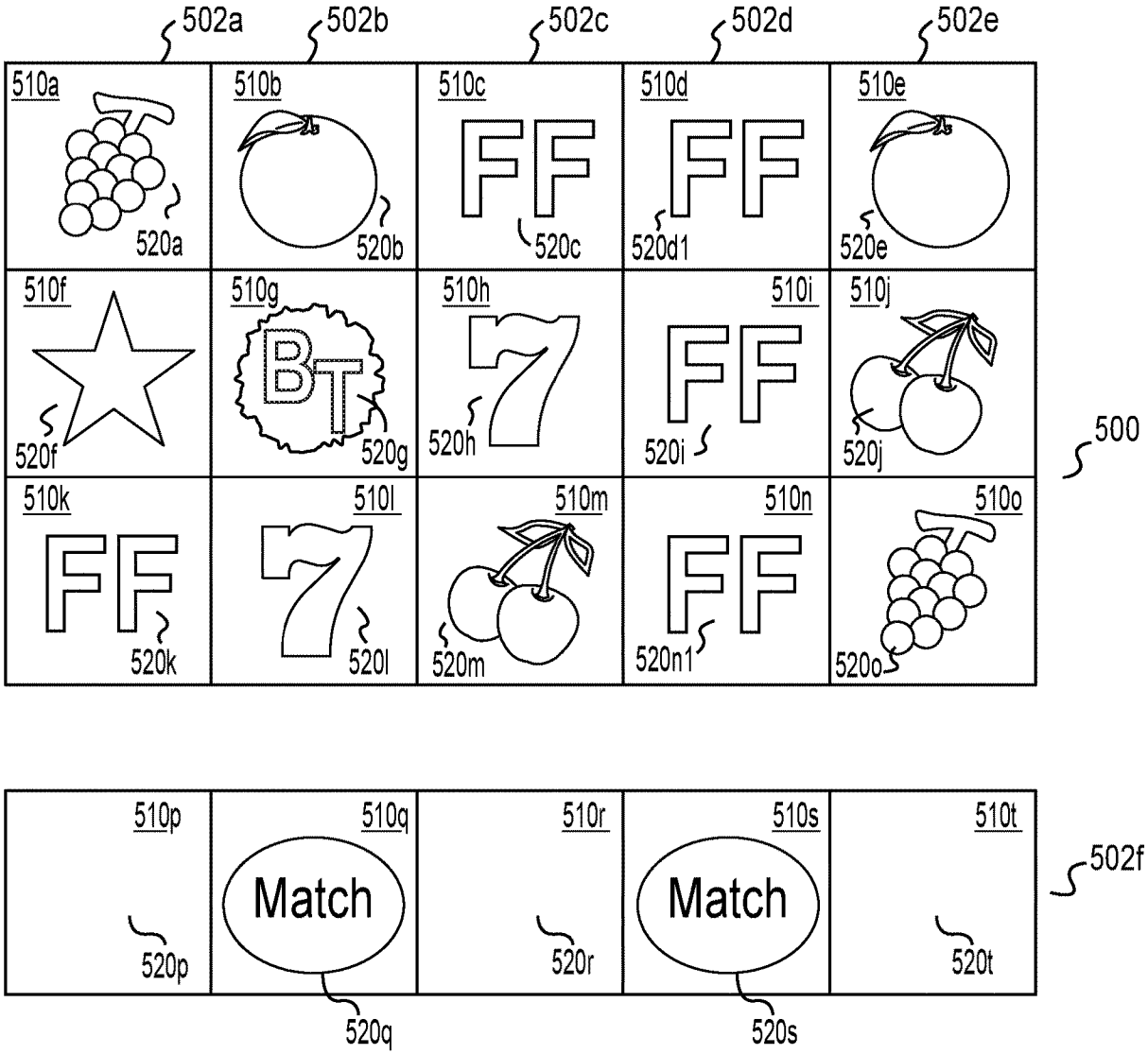

In one embodiment of FIG. 5B, the gaming system performs an evaluation of the generated symbols on reels 502*a*-502*f* and determines whether to execute certain game functions based in part on interactions between the displayed symbols. In one embodiment, the gaming system determines whether any interacting symbols were generated and displayed in reel 502*f*. In the illustrated embodiment of FIG. 5B, the gaming system determines that Match symbols, one type of interacting symbol, were generated and displayed in positions 510*q* and 510*s* of reel 502*f*. The gaming system may then determine which reel or column of symbols is associated with each of the interacting symbols 520*q* and 520*s* (or symbol display areas 510*q* and 510*s*). As noted above, the association between the interacting symbol (or symbol display area) may determine which displayed symbols on which reels the gaming system will evaluate to determine what interactions (if any) the gaming system will execute.

In the embodiment illustrated in FIG. 5B, the gaming system determines that interacting symbol 520*q* is associated with reel 502*b* and interacting symbol 520*s* is associated with reel 502*d*. Based at least in part on this determination, the gaming system determines if any of the symbols 520*b*, 520*g*, and 520*l* interacts with the interacting symbol 520*q*. The gaming system may also determine if any of the symbols 520*d*, 520*i*, and 520*n* interacts with the interacting symbol 520*s*. The forgoing determinations can be made in any order.

In one embodiment, the gaming system determines (such as using processor 202) that the reel 502*d* includes a Flipside Frenzy symbol 520*i* and also determines that a Flipside Frenzy symbol 520*i* interacts with the interacting symbol 520*s*. In this embodiment, the Flipside Frenzy symbol interacts with the interacting symbol 520*s* to cause the gaming system to change the behavior of symbols around the Flipside Frenzy symbols.

In one embodiment, the gaming system may be specially programmed to cause symbol 520*d* and 520*n* of reel 502*d* in FIG. 5B to convert into Flipside Frenzy symbols because the Flipside Frenzy symbol 520*i* appeared in the reel 502*d* which is associated with interacting symbol 520*s* (or symbol display area 510*s*). In one embodiment, the Flipside Frenzy symbol may interact with the match symbol 520*s* to cause the Flipside Frenzy symbol to overwrite or replace symbols 520*d* and 520*n*. On the other hand, as shown in FIG. 5B, while Flipside Frenzy symbols are also visibly displayed as 520*c* and 520*k*, if the Flipside Frenzy symbol is not in a column or reel associated with a generated match symbol in reel 502*f* (symbol display areas 510*p* and 510*r* have blank symbols), the gaming system may determine not to change symbols on reels 502*a* and 502*c* into Flipside Frenzy symbols.

In one embodiment, the gaming system also determines (such as using processor 202) that the reel 502*b* includes a BT symbol 520*g* and also determines that a BT symbol 520*g* interacts with the interacting symbol 520*q*. In this embodiment, the Flipside Frenzy symbol interacts with the interacting symbol 520*q* to cause the gaming system to start a bonus game. As illustrated in FIG. 5B, the gaming system may highlight the BT symbol 520*g* in some manner to further illustrate the interaction between the interacting symbol 520*q* and BT symbol 520*g* to the player. In one embodiment, the where Flipside Frenzy symbols are present, the interaction between the interacting symbol 520*q* and BT symbol 520*g* may also cause any displayed Flipside Frenzy symbols to become "sticky" symbols in the bonus game. That is, in the bonus game, displayed Flipside Frenzy symbols may remain in their existing symbol display areas for the bonus game while the gaming system generates new symbols in the other symbol positions on reels 502*a*-502*e*.

It should be appreciated that in some embodiments, the gaming system may evaluate the symbol combinations in the base game for winning symbol combinations before proceeding to the bonus game. If winning symbol combinations are created in the base game, the gaming system may award the player the appropriate credits for the base game before the bonus game starts. In some embodiments, the gaming system may wait until the conclusion of the bonus game before awarding any credits for the base game.

Figure 5C:
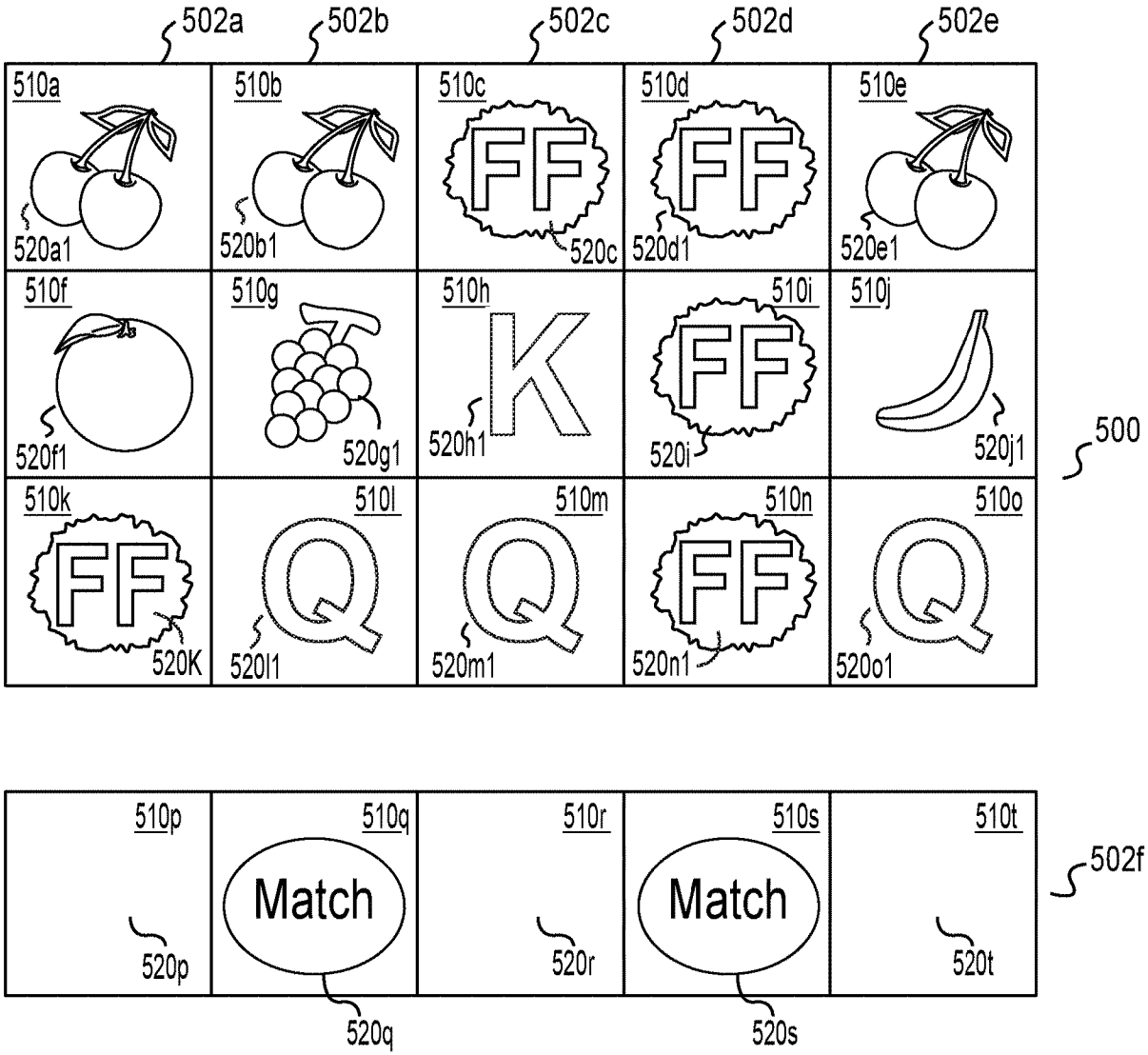

As illustrated in FIG. 5C, the gaming system started the bonus game. In some embodiments, the gaming system automatically starts the bonus game. In other embodiments, the gaming system waits for the player to initiate the bonus game using a suitable player input. In the embodiment of FIG. 5C, the bonus game includes a free spin of the reels.

FIG. 5C illustrates the gaming system displaying of a plurality of symbols from a first set symbols on reels 502*a*-502*e*. In this embodiment, the symbols on reel 502*f* do not change. However, it should be appreciated that in some embodiments the gaming system can generate new symbols from the second set of symbols for reel 502*f* and perform further symbol interaction evaluations in the bonus game. In other embodiments, the gaming system may remove reel 502*f* from the display and not process symbol interactions during the bonus game.

Returning now to FIG. 5C, the gaming system randomly generated at least some new symbols on reels 502*a*-502*e*, as previously described. Thus, stopped reels 502*a*-502*e* now displays some new symbols and some symbols generated in the base game in symbol display areas 510*a*-510*o*, respectively. Specifically, as illustrated in FIG. 5A, the gaming system randomly generated and displayed new symbols 520*a*1 and 520*f*1 in symbol display area 510*a* and 510*f* for reel 502*a*. The gaming system also randomly generated and displayed new symbols 520*b*1, 520*g*1, and 52011 in symbol display areas 510*b*, 510*g*, and 510*l* for reel 502*b*; symbols 520*h*1 and 520*m*1 in symbol display areas 510*h* and 510*m* for reel 502*c*; and symbols 520*e*1, 520*j*1, and 520*o*1 in symbol display area 510*e*, 510*j*, and 510*o* for reel 502*e*.

As noted above, in one embodiment, certain symbols from the base game were made "sticky" for purposes of the bonus game. That is, the gaming system did not randomly generate new symbols to replace the Flipside Frenzy symbols 520*k*, 520*c*, 520*d*, 520*i*, and 520*n*. Rather, the gaming system allowed the Flipside Frenzy symbols to remain displayed for the bonus game, providing a chance for the player to use the many Flipside Frenzy symbols for increased chances to win in the bonus game. As also illustrated in FIG. 5C, the gaming system may highlight the symbols 520*k*, 520*c*, 520*d*, 520*i*, and 520*n* to let the player know that the symbol interactions turned these symbols "sticky" for the bonus game. It should be appreciated that other suitable symbols can be made "sticky" for bonus game, free spins, or other suitable games.

Figure 5D:
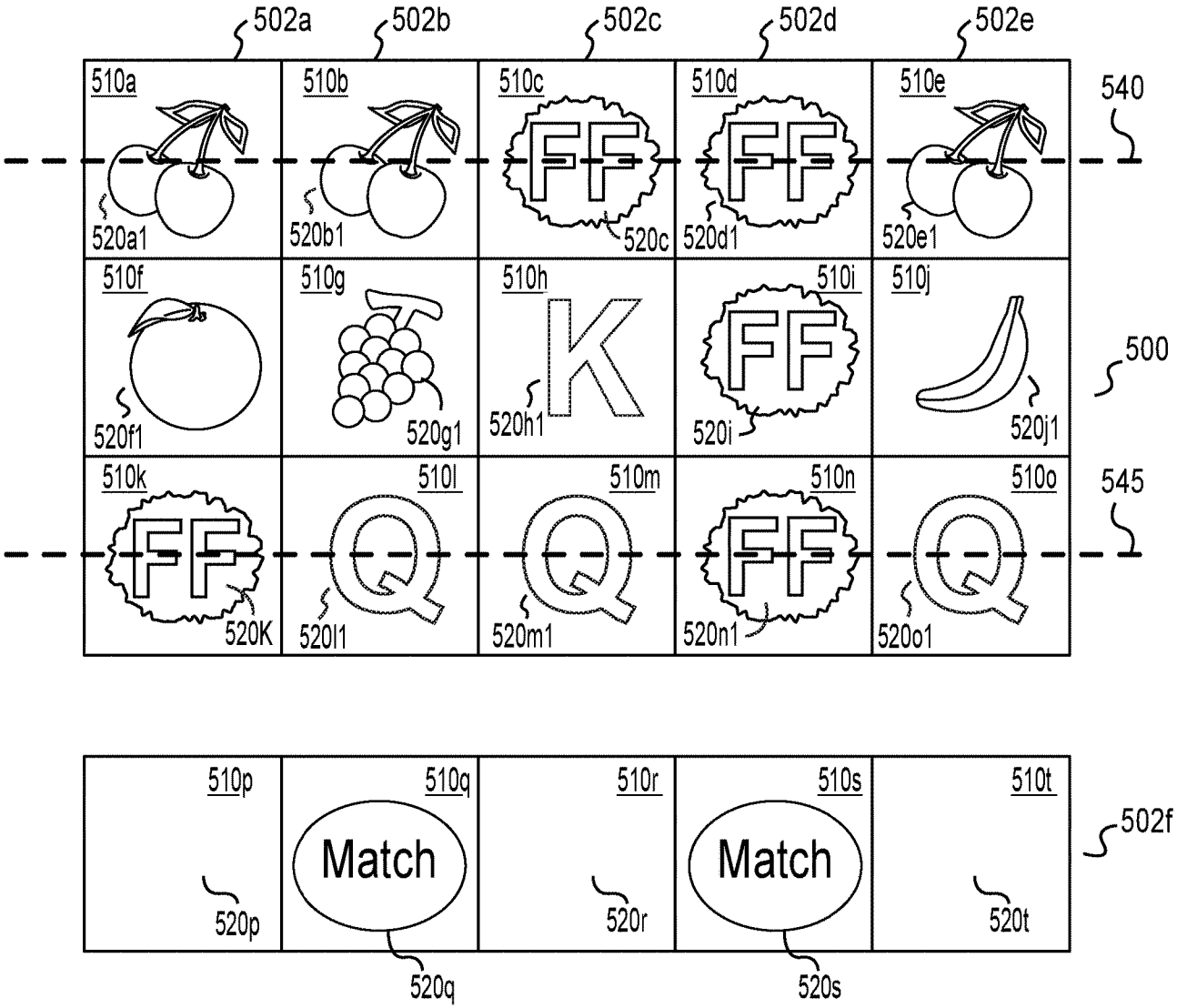

In FIG. 5D, the player has completed the free spin in the bonus game. The gaming device then evaluates the displayed symbol combinations for winning symbol combinations in the bonus game. FIG. 5D illustrates one embodiment of the gaming system executing an evaluation of the displayed symbol combinations for winning symbol combinations. As noted above, the player may have wagered on one or more pay lines, which the gaming system can evaluate for winning symbol combinations. In the embodiment illustrated in FIG. 5D, the player wagered on at least two different pay lines 540 and 545. As noted above, the gaming system can be configured to enable a player to wager on any suitable number of pay lines and thus evaluate any suitable number of winning symbol combinations along the pay lines.

In the embodiment illustrated in FIG. 5D, the gaming system evaluated pay line 540 that combines symbols 520*a*1, 520*b*1, 520*c*, 510*d*1, and 520*e*1 for a winning symbol combination of five cherries. As noted above, the Flipside Frenzy symbols mimics other symbols. In the illustrated embodiment, the Flipside Frenzy symbols 520*c* and 520*d*1 mimic the cherry symbols 520*a*1, 520*b*1, and 520*e*1 to produce the winning combination along pay line 540. The gaming system evaluated pay line 545 that combines symbols 510*k*, 510*l*1, 510*m*1, 510*n*1, and 510*o*1 for a winning symbol combination of five queens. For this pay line evaluation, the Flipside Frenzy symbols mimicked the queen symbols.

Based on the winning symbol combinations along the pay lines 540 and 545 the gaming system awards the appropriate number of credits to the player and updates the player's credit meter to reflect the winnings. The gaming system may display the number of winning credits and may display the player's total credit balance in a display of the gaming system. The gaming system may return to the base game if additional base games features can be executed.

The player may continue the gaming session by playing another game as discussed above. However, continued game play is dependent of the number of credits the player has in the player's credit balance. If the player does not retain enough credits in the player's credit balance, the game system may enable the player to insert additional value to replenish the player's credit balance. The player may also choose to cash out. In such an instance, the gaming system provides the player a value based on the player's credit balance using any of the value items discussed above (bills, coins, vouchers, etc.)

Figure 6:
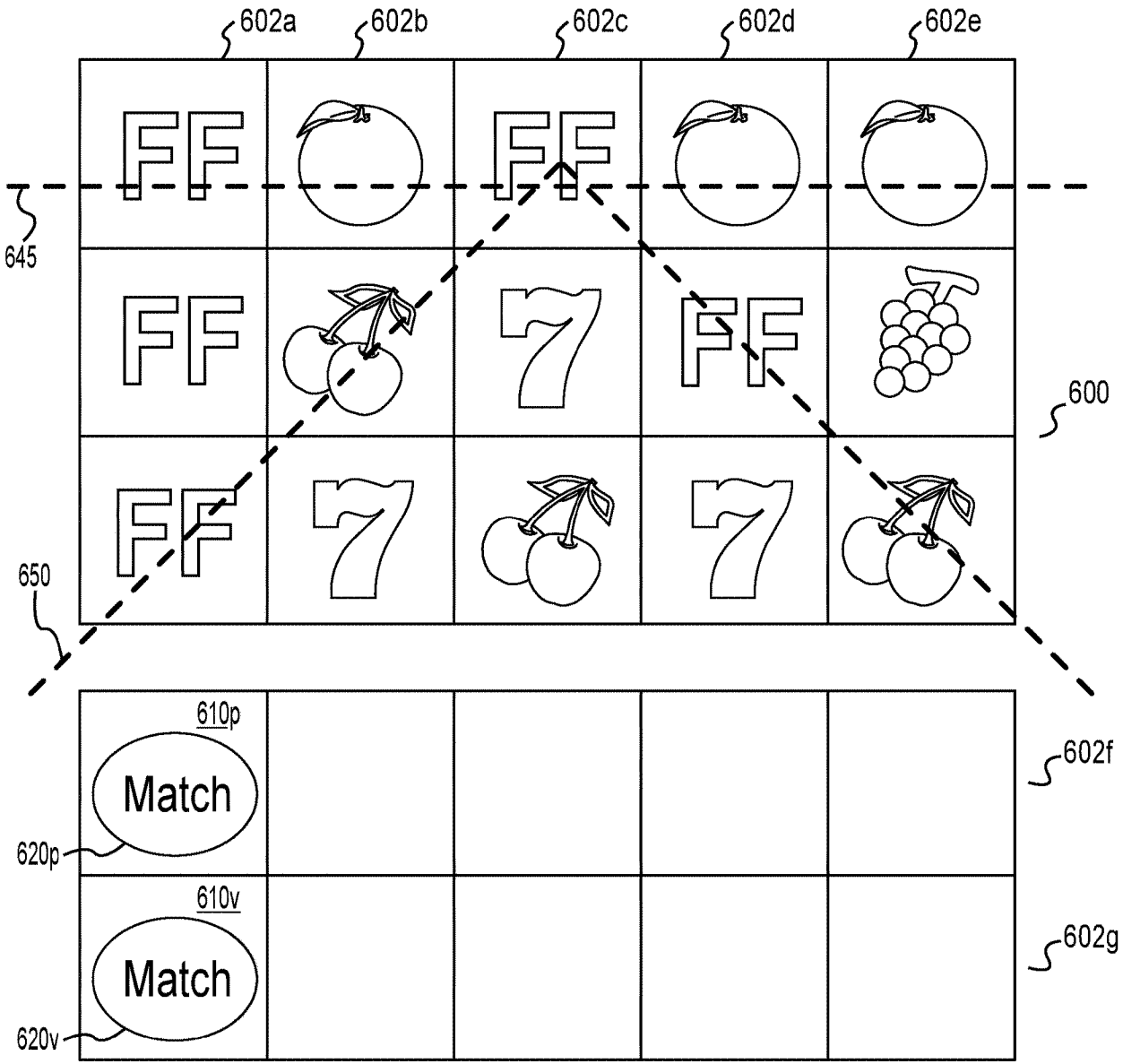
FIG. 6 illustrates screen shots of another example embodiment of a gaming system having a plurality of non-interacting reels.

The gaming system may also include two or more non-interacting reels. In one such example with two non-interacting reels, the non-interacting reels are displayed as stacked on top of each other. However, the two non-interacting reels may include any suitable amount of separation between the reels. In one such embodiment, the gaming system may evaluate the symbols displayed on the first set of reels for interactions with interacting symbols if an interacting symbol is generated and displayed for each non-interacting reel. In one embodiment, both interacting symbols must appear in a symbol display area that is associated with the same reel of the first set of reels. For example, a first interacting symbol is displayed and is associated with a first reel and a second interacting symbol is displayed in the other non-interacting reel that is also associated with the first reel. FIG. 6 illustrates one such embodiment.

FIG. 6 illustrates a screen shot 600 of one embodiment of a gaming system having a plurality of non-interacting reels and a plurality of interacting symbols. For purposes of brevity, a play of a game illustrated in FIG. 6 is similar to a play of the games described above and will not be described again in full. However, in FIG. 6, because the gaming system uses two non-interacting reels 602*f* and 602*g* during a play of a game, differences in the game play will be further discussed.

For example, in FIG. 6, after the gaming system randomly generates symbols for reels 602*a*-602*g*, the gaming system may determine whether interacting symbols appear in both reel 602*f* and 602*g*. If the gaming system determines that interacting symbols do not appear in both reel 602*f* and 602*g*, the gaming system may skip any further processing of the non-interacting reels and proceed to evaluating the generated symbols in reels 602*a*-602*e* for winning symbol combinations, as previously discussed.

If the gaming system determines that interacting symbols appear in both reel 602*f* and 602*g*, the gaming system may determine if both interacting symbols are associated with the same reel. In the embodiment illustrated in FIG. 6, both symbols 620*p* and 620*u* are associated with reel 602*a*. In one such embodiment, the gaming system may then determine whether both interacting symbols 620*p* and 620*u* are the same interacting symbol. In one embodiment, both interacting symbols must be the same before the gaming device will determine if any symbols in the associated reel (reel 602*a* in this example) interact with the interacting symbols 620*p* and 620*u*. However, it should be appreciated that in other embodiments, the interacting symbols do not need to be the same. In some embodiments, the interacting symbols must be different before the gaming system proceeds to determine whether such interacting symbols interact with any of the symbols in reel 602*a*. In some such embodiments with different interacting symbols, it should be appreciated that the gaming system may execute different interactions in during a play of a game based on the different interacting symbols.

Returning to FIG. 6, if the gaming system determines that both interacting symbols 620*p* and 620*u* are the same, the gaming system then determines whether such interacting symbols interact with any of the symbols in reel 602*a*. The gaming system may execute the interactions and game functions if any symbol interactions are determined, as previously described with respect to the other figures.

In the embodiment illustrated in FIG. 6, the interacting symbols 620*p* and 620*u* caused reel 602*a* to fill with Flipside Frenzy symbols. Due to the expansion of the Flipside Frenzy symbols, the gaming system determined that multiple winning symbol combinations were displayed as shown by pay lines 645 and 650. The gaming system may complete the game as previously described with respect to the other figures.

Figure 7:
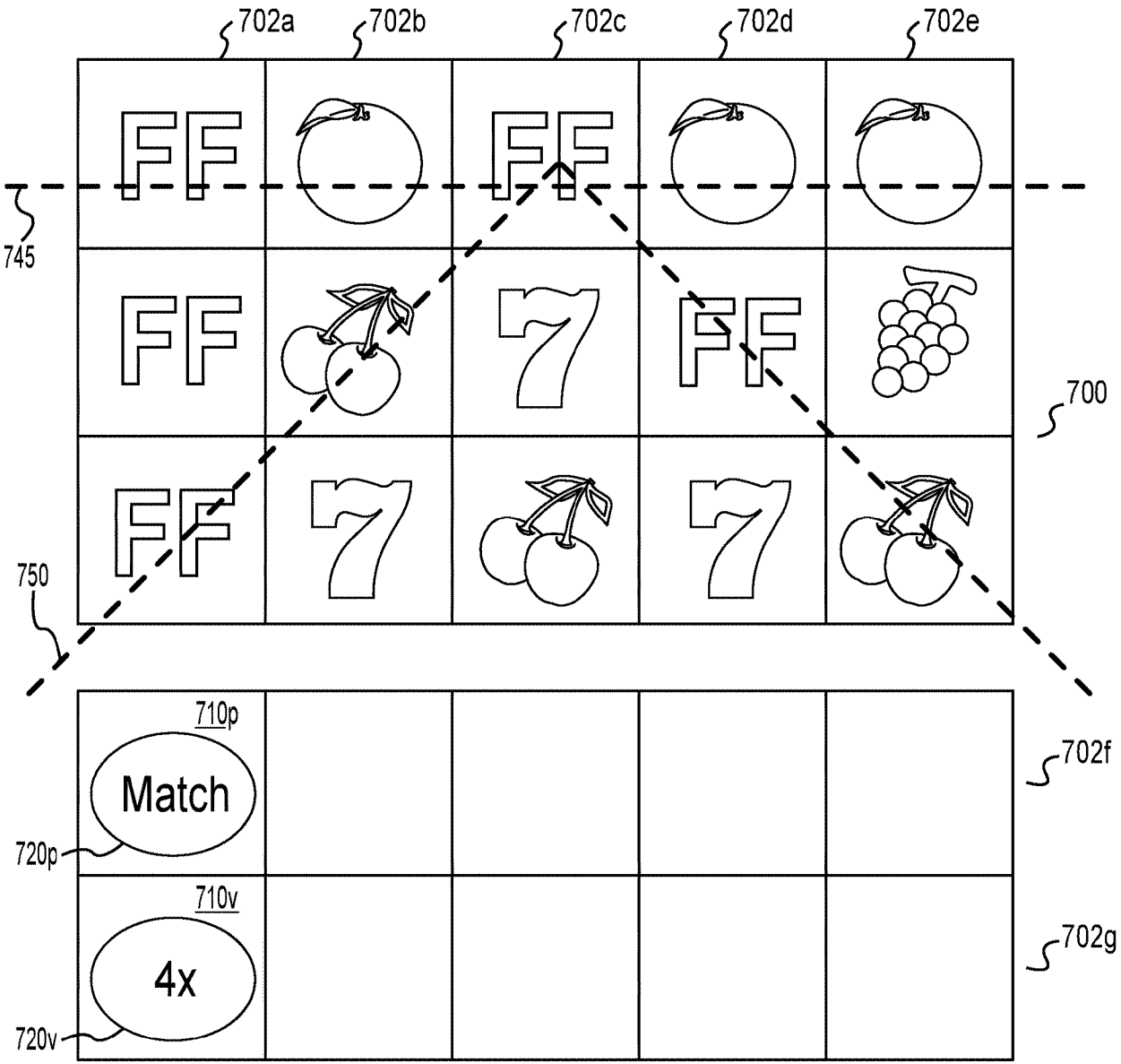
FIG. 7 illustrates screen shots of another example embodiment of a gaming system having a plurality of non-interacting reels.

In another embodiment with multiple non-interacting reels, a first interacting symbol may appear in a symbol display area of one non-interacting reel to cause symbols in a reel to change their behavior while a second interacting symbol may appear in another non-interacting reel to cause the gaming system to perform a payout multiplier on any winning outcomes. FIG. 7 illustrates one such embodiment.

FIG. 7 illustrates a screen shot 700 of one embodiment of a gaming system having a plurality of non-interacting reels and a plurality of interacting symbols. For purposes of brevity, a play of a game illustrated in FIG. 7 is similar to a play of the games described above and will not be described again in full. However, in FIG. 7, because the gaming system uses two non-interacting reels 702*f* and 702*g* during a play of a game, differences in the game play will be further discussed.

For example, in FIG. 7, after the gaming system randomly generates symbols for reels 702*a*-702*g*, the gaming system may determine whether interacting symbols appear in both reel 702*f* and 702*g*. If the gaming system determines that interacting symbols do not appear in both reel 702*f* and 702*g*, the gaming system may skip any further processing of the non-interacting reels and proceed to evaluating the generated symbols in reels 702*a*-702*e* for winning symbol combinations as previously discussed. Is should be appreciated that in some embodiments, if an interacting symbol is displayed in just one non-interacting reel, then the gaming system may proceed with the symbol interaction evaluations as discussed above.

If the gaming system determines that interacting symbols appear in both reel 702*f* and 702*g*, the gaming system may determine if both interacting symbols are associated with the same reel. In the embodiment illustrated in FIG. 7, both symbols 720*p* and 720*u* are associated with reel 702*a*. In one such embodiment, the gaming system may then determine whether both interacting symbols 720*p* and 720*u* are the same interacting symbol. In this embodiment, both interacting symbols do not need to be the same before the gaming device will determine if any symbols in the associated reel (reel 702*a* in this example) interact with the interacting symbols 720*p* and 720*u*.

In the embodiment of FIG. 7, the gaming system determines that the interacting symbols 720*p* and 720*u* are different. The gaming system then determines what interactions, if any, each of the interacting symbols may have with the symbols displayed in an associated reel. In this embodiment, interacting symbols 720*p* and 720*u* are both associated with reel 702*a*, thus the gaming system determines whether such interacting symbols interact with any of the symbols in reel 702*a*. The gaming system may execute the interactions and game functions if any symbol interactions are determined, as previously described with respect to the other figures.

In the embodiment of FIG. 7, because the interacting symbols are different, the gaming system may execute different interactions during a play of a game based on the different interacting symbols. For example, the Match symbol 720*p* may interact with a symbol in reel 702*a* to change other symbols in the reel 702*a*. In some embodiments, payout multiplier 720*u* interacts with a symbol in reel 702*a* to provide a payout multiplier. However, in some embodiments, it should be appreciated that a payout multiplier may not require a symbol in reel 702*a* to interact with. That is, in some embodiments, if the gaming system executed at least one other interaction (such as the interaction with interacting symbol 720*p*), when the payout multiplier is displayed, the gaming system will multiply any determined awards by the multiplier. In yet other embodiments, if the payout multiplier is displayed on any non-interacting reel, the gaming system may multiply any determined awards by the multiplier regardless of interactions with the interacting multiplier symbol or any other symbol interactions.

In the embodiment illustrated in FIG. 7, the interacting symbol 720*p* caused reel 702*a* to fill with Flipside Frenzy symbols. Due to the replacement of other symbols on reel 702*a* with Flipside Frenzy symbols, the gaming system determined that multiple winning symbol combinations were displayed as shown by pay lines 745 and 750. In this embodiment, due to the interaction between the interacting symbol 720*p* and a symbol on reel 702*a*, the gaming system also multiplied any determined award by four. The gaming system may complete the game as previously described with respect to the other figures.

In some embodiments, the symbol interactions are performed in a particular order. For example, if a particular order of execution of a plurality of symbol interactions provided a player with a better winning combination of symbols, the gaming system may execute the plurality of symbol interactions in the particular order. However, in some embodiments, the particular order of execution of a plurality of symbol interactions does not matter and the gaming system may execute the symbol interactions in any suitable order.

Figure 8:
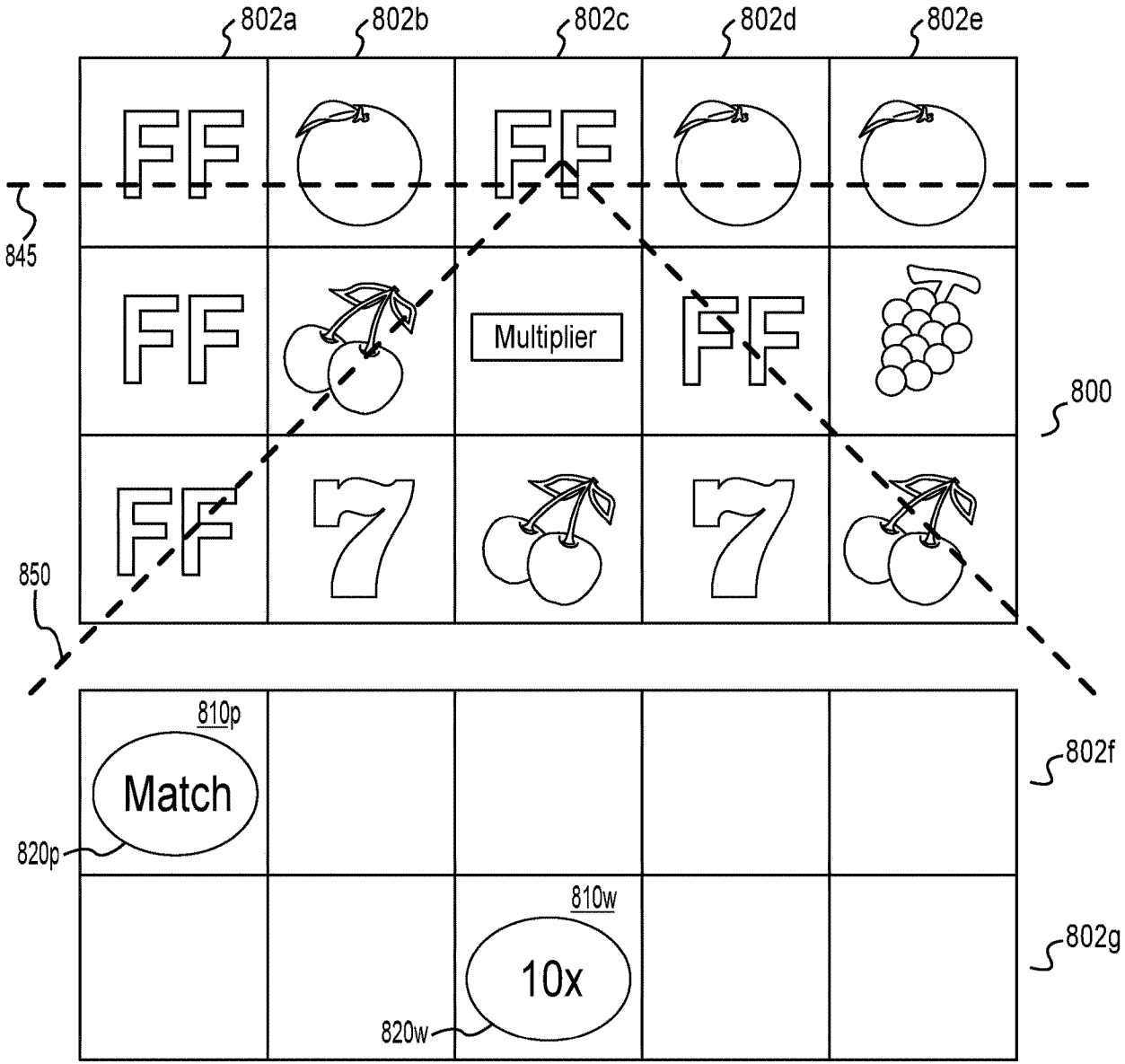
FIG. 8 illustrates screen shots of another example embodiment of a gaming system having a plurality of non-interacting reels.

In another embodiment with multiple non-interacting reels, interacting symbols may be displayed in different non-interacting reels and be associated with different reels. In these embodiments, the gaming system may still execute symbol interactions based on each of the displayed interacting symbols. For example, a first interacting symbol may appear in a symbol display area of one non-interacting reel to cause symbols in certain reels to change their behavior while a second interacting symbol may appear in another non-interacting reel to cause the gaming system to perform a payout multiplier on any winning outcomes. FIG. 8 illustrates one such embodiment.

FIG. 8 illustrates a screen shot 800 of one embodiment of a gaming system having a plurality of non-interacting reels and a plurality of interacting symbols. For purposes of brevity, a play of a game illustrated in FIG. 8 is similar to a play of the games described above and will not be described again in full. However, in FIG. 8, because the gaming system uses two non-interacting reels 802*f* and 802*g* during a play of a game, differences in the game play will be further discussed.

For example, in FIG. 8, after the gaming system randomly generates symbols for reels 802*a*-802*g*, the gaming system may determine whether interacting symbols appear in both reels 802*f* and 802*g*. If the gaming system determines that interacting symbols do not appear in both reels 802*f* and 802*g*, the gaming system may skip any further processing of the non-interacting reels and proceed to evaluating the generated symbols in reels 802*a*-802*e* for winning symbol combinations, as previously discussed. It should be appreciated that in some embodiments, if an interacting symbol is displayed in just one non-interacting reel, then the gaming system may proceed with the symbol interaction evaluations as discussed above.

If the gaming system determines that interacting symbols appear in both reels 802*f* and 802*g*, the gaming system may determine if both interacting symbols are associated with the same reel. In the embodiment illustrated in FIG. 8, interacting symbols 820*p* and 820*w* are not associated with the same reel. Interacting symbol 820*p* is associated with reel 802*a* and interacting symbol 820*w* is associated with reel 802*c*. In this embodiment, the interacting symbols do not need to be associated with the same reel for the gaming system to execute the symbol interactions.

It should be appreciated that while the association of an interacting symbol to a reel has generally been illustrated as based on an interacting symbol being vertically aligned with a reel, the gaming system may randomly generate an association between an interacting symbol and any particular reel. In such alternative embodiments, the gaming system may provide at least one other visual clue to allow a player to understand which interacting symbol is associated with which reel.

Returning to the embodiment of FIG. 8, the gaming system determines that both interacting symbols 820*p* and 820*u* are different. The gaming system then determines what interactions, if any, each of the interacting symbols may have with the symbols in an associated reel. In this embodiment, interacting symbols 820*p* is associated with reel 802*a*, thus the gaming system determines whether such interacting symbol interacts with any of the symbols in reel 802*a*. In this embodiment, interacting symbol 820*w* is associated with reel 802*c*, thus the gaming system determines whether such interacting symbol interacts with any of the symbols in reel 802*c*. The gaming system may execute the interactions and game functions if any symbol interactions are determined as previously described with respect to the other figures.

In the embodiment of FIG. 8, because the interacting symbols are different the gaming system may execute different interactions in during a play of a game based on the different interacting symbols. For example, the Match symbol 820*p* may interact with a symbol in reel 802*a* to change other symbols in the reel 802*a*. In some embodiments, payout multiplier 820*w* interacts with a symbol in reel 802*c* to provide a payout multiplier. However, in some embodiments, it should be appreciated that a payout multiplier may not require a symbol in reel 802*c* to interact with before the gaming system provides the player the payout multiplier. That is, in some embodiments, if the gaming system executed at least one other interaction (such as an interaction with interacting symbol 820*p*), when the payout multiplier is displayed, the gaming system will multiply any determined awards by the multiplier. In yet other embodiments, if the payout multiplier is displayed on any non-interacting reel, the gaming system may multiply any determined awards by the multiplier regardless of interactions with the interacting multiplier symbol or any other interacting symbol interactions.

In the embodiment illustrated in FIG. 8, the interacting symbols 820*p* caused reel 802*a* to fill with Flipside Frenzy symbols. Due to the replacement of other symbols on reel 802*a* with Flipside Frenzy symbols, the gaming system determined that multiple winning symbol combinations were displayed as shown by pay lines 845 and 850. In this embodiment, due to the interaction between the interacting symbol 820*w* and a multiplier symbol on reel 802*c*, the gaming system also multiplied any determined award by 10 due to the symbol interaction. The gaming system may complete the game as previously described with respect to the other figures.

It should be appreciated that non-interacting reels with interacting symbols increase a game player's anticipation for the possible game outcomes. Even if no winning symbol combinations are determined after an initial generation of symbols or after an initial spin of a set of gaming reels, associating interacting symbols with a reel to produce symbol interactions can dramatically alter the winning symbol combinations formed after the initial symbols are displayed.

By identifying a column of displayed symbols and then altering symbols in a column based upon the interaction characteristics of symbols, the gaming system described herein creates a new level of game element interactions within a game. This also adds a new level of anticipation and excitement for game players.

The non-interacting reels also increase the amount of screen "real estate" that a game uses on a screen. One problem that game designers face is that the use of increasing larger displays in gaming devices creates a lot of unused space. The unused space can be distracting to players and may cause players to find a gaming device less appealing. Some game designers have simply added more reels and symbols, which are all used to determine winning symbol combinations. Adding more reels and symbols that are used in determining winning symbol combinations leads to games with lower volatility by mathematical necessity. By adding non-interacting reels, a game designer can minimize the volatility issues while also filing out unused screen space and provide additional levels of anticipation and excitement for game players. Thus, adding the non-interacting reels to a gaming system further provides a technical solution to the technical problem of unused display "real estate" created by larger displays without negatively impacting volatility of a game.

A number of embodiments of the invention have been described. It should be understood that various modifications may be made without departing from the spirit and scope of the invention. For example, various forms of the flows shown above may be used, with steps re-ordered, added, or removed. Accordingly, other embodiments are within the scope of the following claims.

We claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

receive a wager input from the input device, the credit balance being decreased by the wager;

randomly generate a first plurality of symbols from a first set of symbols;

display, using the display device, the first plurality of symbols in a plurality of first reels;

randomly generate at least one interacting symbol from a second set of symbols;

display, using the display device, the at least one interacting symbol in a second reel that is different from the plurality of first reels, wherein the second reel comprises a plurality of symbol display areas and at least one of the plurality of symbol display areas of the second reel corresponds to one of the plurality of first reels;

determine that a predetermined symbol is displayed in the one of the plurality of first reels, wherein the predetermined symbol is configured to interact with the at least one interacting symbol;

alter a symbol of the first plurality of symbols based on the at least one interacting symbol interacting with the predetermined symbol;

display, using the display device, the altered symbol;

determine an award based on a winning combination of the altered symbol and unaltered symbols of the first plurality of symbols, without including the interacting symbol in the winning combination;

display the award, the credit balance being increased by the award; and issue value from the value dispenser based on the credit balance upon receipt of a cash out signal.

2. The gaming system of claim 1, further comprising altering at least one additional symbol of the first plurality of symbols based on the at least one interacting symbol interacting with the predetermined symbol.

3. The gaming system of claim 2, wherein the altered at least one additional symbol is displayed in a reel of the plurality of first reels that displays the predetermined symbol.

4. The gaming system of claim 1, wherein altering the symbol of the first plurality of symbols further comprises altering the predetermined symbol.

5. The gaming system of claim 1, wherein altering the symbol of the first plurality of symbols further comprises altering the predetermined symbol and altering at least one additional symbol of the first plurality of symbols.

6. The gaming system of claim 1, wherein the at least one interacting symbol interacts with the predetermined symbol when the predetermined symbol is displayed in a reel of the plurality of first reels and the at least one interacting symbol is displayed in the at least one of the plurality of symbol display areas of the second reel that corresponds with the reel of the plurality of first reels.

7. The gaming system of claim 1, wherein the predetermined symbol is evaluated as a wild symbol when the predetermined symbol does not interact with the interacting symbol.

8. The gaming system of claim 1, further comprising altering a plurality of a first type of symbols on a reel of the plurality of first reels that also displays the predetermined symbol, without altering at least one of a second type of symbol on the reel of the plurality of first reels that also displays the predetermined symbol.

9. The gaming system of claim 1, wherein the predetermined symbol remains displayed when the processor further:

randomly generates a second plurality of symbols from the first set of symbols;

displays the generated second plurality of symbols with the predetermined symbol; and determines an award based on a second winning combination of the predetermined symbol and the second plurality of symbols.

10. The gaming system of claim 1, further comprising blocking the alteration of the symbol of the first plurality of symbols when the value of the award value based on the altered symbol is lower than a second award that would have been available without altering the symbol of the first plurality of symbols.

11. A method of operating a gaming system, the method comprising:

receiving a monetary value through a value acceptor of the gaming system;

establishing a credit balance based at least in part on the received monetary value;

receiving a wager input from an input device of the gaming system, the credit balance being decreased by the wager;

randomly generating, using a processor and a random number generator of the gaming system, a first plurality of symbols from a first set of symbols;

displaying, using a display device of the gaming system, the first plurality of symbols in a plurality of first reels;

randomly generating, using the processor and the random number generator, at least one interacting symbol from a second set of symbols;

displaying, using the display device, the at least one interacting symbol in a second reel that is different from the plurality of first reels, wherein the second reel comprises a plurality of symbol display areas and at least one of the plurality of symbol display areas of the second reel corresponds to one of the plurality of first reels;

determining, using the processor, that a predetermined symbol is displayed in the one of the plurality of first reels, wherein the predetermined symbol is configured to interact with the at least one interacting symbol;

altering, using the processor, a symbol of the first plurality of symbols based on the at least one interacting symbol interacting with the predetermined symbol;

displaying, using the display device, the altered symbol;

determining, using the processor, an award based on a winning combination of the altered symbol and unaltered symbols of the first plurality of symbols, without including the interacting symbol in the winning combination;

displaying the award, the credit balance being increased by the award; and issuing value, from a value dispenser of the gaming system, based on the credit balance upon receipt of a cash out signal.

12. The method of claim 11, further comprising altering at least one additional symbol of the first plurality of symbols based on the at least one interacting symbol interacting with the predetermined symbol.

13. The method of claim 12, wherein the altered at least one additional symbol is displayed in a reel of the plurality of first reels that displays the predetermined symbol.

14. The method of claim 11, wherein altering the symbol of the first plurality of symbols further comprises altering the predetermined symbol.

15. The method of claim 11, wherein altering the symbol of the first plurality of symbols further comprises altering the predetermined symbol and altering at least one additional symbol of the plurality of symbols.

16. The method of claim 11, wherein the at least one interacting symbol interacts with the predetermined symbol when the predetermined symbol is displayed in a reel of the plurality of first reels and the at least one interacting symbol is displayed in the at least one of the plurality of symbol display areas of the second reel that corresponds with the reel of the plurality of first reels.

17. The method of claim 11, wherein the predetermined symbol is evaluated as a wild symbol when the predetermined symbol does not interact with the interacting symbol.

18. The method of claim 11, further comprising altering a plurality of a first type of symbols on a reel of the plurality of first reels that also displays the predetermined symbol, without altering at least one of a second type of symbol on the reel of the plurality of first reels that also displays the predetermined symbol.

19. The method of claim 11, wherein the predetermined symbol remains displayed while:

randomly generating, with the processor and the random number generator, a second plurality of symbols from the first set of symbols;

displaying, on the display device, the generated second plurality of symbols with the predetermined symbol; and determining, with the processor, an award based on a second winning combination of the predetermined symbol and the second plurality of symbols.

20. The method of claim 11, further comprising blocking the alteration of the symbol of the first plurality of symbols when the award value based on the altered symbol is lower than a second award that would have been available without altering the symbol of the first plurality of symbols.

21. A non-transitory computer-readable storage medium having machine instructions stored therein, the instructions being executable by a processor to cause the processor to:

receive a monetary value through a value acceptor of a gaming system;

establish a credit balance based at least in part on the received monetary value;

receive a wager input from an input device of the gaming system, the credit balance being decreased by the wager;

randomly generate, using a random number generator of the gaming system, a first plurality of symbols from a first set of symbols;

display, using a display device of the gaming system, the first plurality of symbols in a plurality of first reels;

randomly generate, using the random number generator, at least one interacting symbol from a second set of symbols;

display, using the display device, the at least one interacting symbol in a second reel that is different from the plurality of first reels, wherein the second reel comprises a plurality of symbol display areas and at least one of the plurality of symbol display areas of the second reel corresponds to one of the plurality of first reels;

determine, using the processor, that a predetermined symbol is displayed in the one of the plurality of first reels, wherein the predetermined symbol is configured to interact with the at least one interacting symbol;

alter, using the processor, a symbol of the first plurality of symbols based on the at least one interacting symbol interacting with the predetermined symbol;

display, using the display device, the altered symbol;

determine, using the processor, an award based on a winning combination of the altered symbol and unaltered symbols of the first plurality of symbols, without including the interacting symbol in the winning combination;

display the award, the credit balance being increased by the award; and issue value, from a value dispenser of the gaming system, based on the credit balance upon receipt of a cash out signal.

* * * * *